US007837306B2

(12) United States Patent
Fujishiro

(10) Patent No.: US 7,837,306 B2
(45) Date of Patent: Nov. 23, 2010

(54) VALVE UNIT WITH PRESSURE REGULATING VALVE ASSEMBLED IN LAMINATE BODY

(75) Inventor: Takeshi Fujishiro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1029 days.

(21) Appl. No.: 11/605,455

(22) Filed: Nov. 29, 2006

(65) Prior Publication Data

US 2007/0139488 A1 Jun. 21, 2007

(30) Foreign Application Priority Data

Nov. 29, 2005 (JP) ..... P2005-344657
Nov. 29, 2005 (JP) ..... P2005-344658

(51) Int. Cl.
*B41J 2/045* (2006.01)
*B41J 2/135* (2006.01)

(52) U.S. Cl. ..... 347/72; 347/44

(58) Field of Classification Search ..... 347/85, 347/69, 72, 44; 137/496, 505.38; 417/310
See application file for complete search history.

(56) References Cited

U.S. PATENT DOCUMENTS 3,176,712 A * 4/1965 Ramsden ..... 137/496
4,630,641 A * 12/1986 Lacour ..... 137/505.38
4,971,527 A * 11/1990 Dick ..... 417/310
6,130,694 A * 10/2000 Beatty ..... 347/85
2005/0073559 A1* 4/2005 Aruga et al. ..... 347/85
2005/0231563 A1* 10/2005 Fujishiro et al. ..... 347/69

FOREIGN PATENT DOCUMENTS

| | | | |
|---|---|---|---|
| EP | 0 997 294 | B1 | 6/2004 |
| JP | 7-29414 | B2 | 4/1995 |
| JP | 10-058702 | A | 3/1998 |
| JP | 2001-199080 | A | 7/2001 |
| JP | 2003-127414 | A | 5/2003 |
| JP | 2004-090433 | A | 3/2004 |
| JP | 2005-096404 | A | 4/2005 |
| JP | 2005-186344 | A | 7/2005 |
| JP | 2005-193482 | A | 7/2005 |
| WO | WO 00/03877 | A1 | 1/2000 |
| WO | WO 03/041964 | A1 | 5/2003 |

* cited by examiner

*Primary Examiner*—Stephen D Meier
*Assistant Examiner*—Carlos A Martinez, Jr.
(74) *Attorney, Agent, or Firm*—Sughrue Mion, PLLC

(57) ABSTRACT

A valve unit includes a valve portion arranged in a laminate body operable to open and close a flow passage; a drive portion that generates drive force for driving the valve portion; and a transmission portion arranged between the valve portion and the drive portion for transmitting the drive force of the drive portion to the valve portion. The laminate body includes: a first plate member including the drive portion; and a second plate member including a hole functioning as part of the flow passage; and a third plate member arranged above the second plate member and including a plate spring so as to urge the valve portion to a closing position. The valve portion pivots and inclines about a position in contact with the plate spring based on the drive force from the drive portion.

14 Claims, 10 Drawing Sheets

VALVE UNIT WITH PRESSURE REGULATING VALVE ASSEMBLED IN LAMINATE BODY

BACKGROUND

1. Technical Field

The present invention relates to an ultra compact valve unit for regulating pressure and to a liquid ejection device provided with such a valve unit.

2. Related Art

A liquid ejection device includes an inkjet-type printer (hereinafter referred to as a "printer"). Printers are provided with replaceable ink cartridges (hereinafter referred to as a "cartridge"). A printer accomplishes printing by ejecting (discharging) ink, which is supplied by a cartridge, from a recording head. There are several conventional methods for supplying ink from a cartridge to a recording head. The pressure on the ink must be suitably regulated so as to stably discharge ink droplets from the recording head. Therefore, printers include a valve unit (differential pressure valve or pressure reducing valve) to regulate ink pressure according to the ink supplying method used.

JP-T-2000-03877 discloses a differential valve built into a cartridge. This cartridge is mounted on a carriage and referred to as an on-carriage cartridge.

JP-A-2001-199080 discloses a carriage provided with a sub tank. The sub-tank recording device detects the amount of ink in accordance with the intensity of the magnetic line of force of a permanent magnet that varies depending on the floating position of a float member by means of electromagnetic conversion element such as a Hall element arranged on a side wall of the sub tank. The ink supply valve opens when the amount of detected ink is less than a predetermined amount.

JP-T-2003-041964 discloses a recording device including a main body provided with a cartridge holder. In this recording device, a cartridge is installed in the cartridge holder on the main body, and a valve unit is mounted on the cartridge. This kind of cartridge is referred to as an off-carriage cartridge.

JP-A-2005-186344 discloses a valve unit provided with a pressure reducing valve that reduces the pressure of a liquid within a pressure chamber containing liquid to a predetermined pressure. This pressure reducing valve is provided with a pressure receiving member that is elastically deformable, a spring used for pressure regulation, and an operating lever and the like. Therefore, the valve unit is large.

Whatever the type, conventional valves are large. Thus, a problem arises when developing compact and portable printers, since a corresponding compact valve unit is not available. The ink supplied to the recording head is regulated to a suitable ink pressure. Conventionally, valve units that regulate ink pressure differ according to the method in which ink is supplied. Therefore, it has been difficult to design a valve unit that would be commonly usable among recording devices that use different ink supplying methods. For example, if an ink pressure regulating valve unit could be built into a recording head, the valve unit could be used commonly among recording devices that employ different methods for supplying ink. However, the recording head would be enlarged since conventional valve units have a large structure. Therefore, there has not been as yet in fact a valve unit that could be built into a recording head.

Furthermore, the outer packaging member (case and the like) of a conventional valve unit is readily permeable to gas since it is typically formed of resin. Thus, the liquid content of the ink within the cartridge may evaporate, and gas that penetrates the interior of the cartridge produces bubbles in the ink. Therefore, the problem of gas permeability that causes moisture evaporation and bubbles must be reduced in such valve units.

SUMMARY

The present invention provides a valve unit incorporating an ultra compact pressure regulating valve, and a liquid ejection device provided with such a value unit.

One aspect of the present invention is a valve unit for opening and closing a flow passage. The valve unit has a laminate body including a plurality of plate members laminated together and forming the flow passage. A valve portion is arranged in the laminate body operable to open and close the flow passage. A drive portion generates drive force for driving the valve portion. The valve portion opening the flow passage based on the drive force of the drive portion. A transmission portion is arranged between the valve portion and the drive portion to transmit the drive force of the drive portion to the valve portion. The plurality of plate members includes a first plate member including the drive portion and a second plate member including a hole functioning as part of the flow passage. The valve portion is moved between a closing position for closing the hole and an opening position for opening the hole based on the drive force of the drive portion transmitted by the transmission portion.

Another aspect of the present invention is a liquid ejection device for use with a removably attached liquid container containing liquid. The liquid container includes a first flow passage for guiding the contained liquid out of the liquid container. The liquid ejection device has a liquid ejection unit including a nozzle for ejecting the liquid and a second flow passage for guiding the liquid supplied from the liquid container to the nozzle. A valve unit opens and closes a flow passage including the first and second flow passages to regulate pressure of the liquid. The valve unit has a laminate body including a plurality of plate members laminated together and forming the flow passage. A valve portion is arranged in the laminate body operable to open and close the flow passage. A drive portion generates drive force to drive the valve portion. The valve portion opens the flow passage based on the drive force of the drive portion. A transmission portion is arranged between the valve portion and the drive portion to transmit the drive force of the drive portion to the valve portion. The plurality of plate members includes a first plate member including the drive portion and a second plate member including a hole functioning as part of the flow passage. The valve portion is moved between a closing position for closing the hole and an opening position for opening the hole based on the drive force of the drive portion transmitted by the transmission portion.

A further aspect of the present invention is a liquid ejection device for use with a removably attached liquid container containing liquid. The liquid ejection device includes a carriage movable along a predetermined path. A liquid ejection unit mounted on the carriage includes a nozzle for ejecting liquid supplied from the liquid container. A valve unit arranged in the liquid ejection unit regulates pressure of the liquid ejected from the nozzle.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

An inkjet recording device (hereinafter referred to as a "recording device") 10 according to a first embodiment of the present invention will now be discussed with reference to FIGS. 1 through 10.

Figure 1:
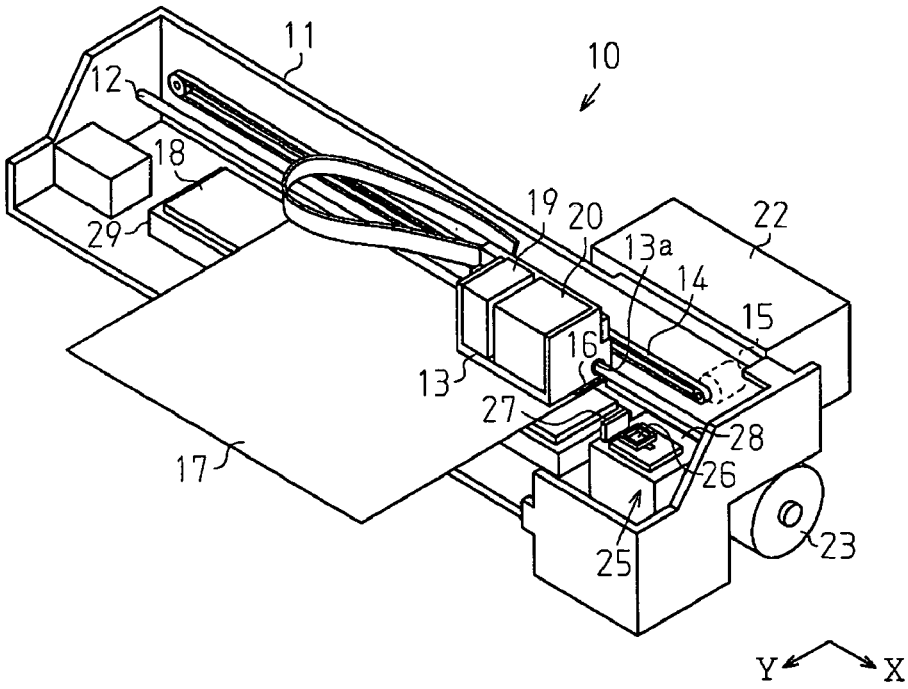
FIG. 1 is a schematic perspective view showing a printer according to a first embodiment of the present invention.

FIG. 1 is a schematic perspective view showing the recording device 10 of the first embodiment. As shown in FIG. 1, the recording device 10, which functions as a liquid ejection device, includes a body frame 11 of a predetermined shape that includes a bottom panel, left and right side panels, and a rear panel. A guide shaft 12, which extends through the body frame 11, is inserted through an insertion hole 13*a* of a carriage 13. The carriage 13 moves freely along the guide shaft 12 in a main scanning direction X. An endless timing belt 14 is arranged at the rear surface of the carriage 13 so as to extend parallel to the axial direction of the guide shaft 12. The carriage 13 is attached to part of the timing belt 14. When a carriage motor 15 arranged near one end of the body frame 11 is actuated so as to produce rotation in the forward direction or reverse direction, the carriage 13 is reciprocates in the main scanning direction X.

An inkjet recording head (hereinafter referred to as a "recording head" 16), which functions as a liquid ejection unit (liquid ejection head), is arranged on the bottom surface of the carriage 13. The bottom surface of the recording head 16 defines a nozzle formation surface 16*a* (refer to FIGS. 2 and 3). A platen 18 that regulates the space between the nozzle formation surface 16*a* and a recording sheet 17 is arranged on the bottom panel of the body frame 11. Furthermore, a black ink cartridge 19 and a color ink cartridge 20 are removably attached to the upper portion of the carriage 13. The recording head 16 ejects (discharges) inks supplied from the ink cartridges 19 and 20 through nozzle holes in the nozzle formation surface 16*a*. For example, inks of three colors, such as cyan (C), magenta (M) and yellow (Y) are separately accommodated in the ink cartridge 20.

The recording device 10 further includes a paper feeding device 22 and a paper tray (not shown in the drawings) located at the rear side of the device. A plurality of recording sheets 17 can be loaded in the paper tray. The paper feeding device 22 separates and feeds only the single uppermost sheet of the recording sheets 17 on the paper tray. When a sheet feed motor 23, which is arranged at one side (right side in this drawing) of the lower portion of the body frame 11, is actuated, the recording sheet 17 is fed in a sub-scanning direction Y. During sheet feeding, the recording sheet 17 is held by a pair of transport rollers (not shown) that are arranged at two front and rear locations along the sub-scanning direction Y. When the carriage 13 reciprocates in the main scanning direction X, an operation is performed to discharge ink from nozzles 16*b* (refer to FIG. 2) of the recording head 16 onto the recording sheet 17. Then, when the carriage 13 is not moving, an operation is performed to feed the recording sheet 17 by a predetermined transport amount in the sub-scanning direction Y. Recording (printing) on the recording sheet 17 is accomplished by alternately repeating the ink discharge operation and the sheet feeding operation. The nozzles 16*b* function as an ejection orifice of the liquid ejection unit in the present invention.

As shown in FIG. 1, a home position is established at one end (the right end in the drawing) of the travel path of the carriage 13. A maintenance unit 25, which cleans the recording head 16, is arranged at the home position. The maintenance unit 25 includes a square cap 26 that prevents ink from drying in the nozzles of the recording head 16, a wiper 27 for wiping the nozzle formation surface 16*a*, and a suction pump 28 arranged adjacent to the cap 26. When the carriage 13 moves to the home position, the recording head 16 is positioned directly above the cap 26. Then, the cap 26 is raised to seal the nozzle formation surface 16*a* of the recording head 16. During cleaning, the suction pump 28 is actuated so as to create negative pressure in the space between the cap 26 and the nozzle formation surface 16*a*, which is sealed by the cap 26. Thus, ink is drawn out of the nozzles of the recording head 16. The drawn out waste ink from the cap 26 is discharged through a tube (not shown) and into a waste tank 29 arranged below the platen 18. The suction pump 28 is actuated by, for example, the sheet feed motor 23.

Figure 2:
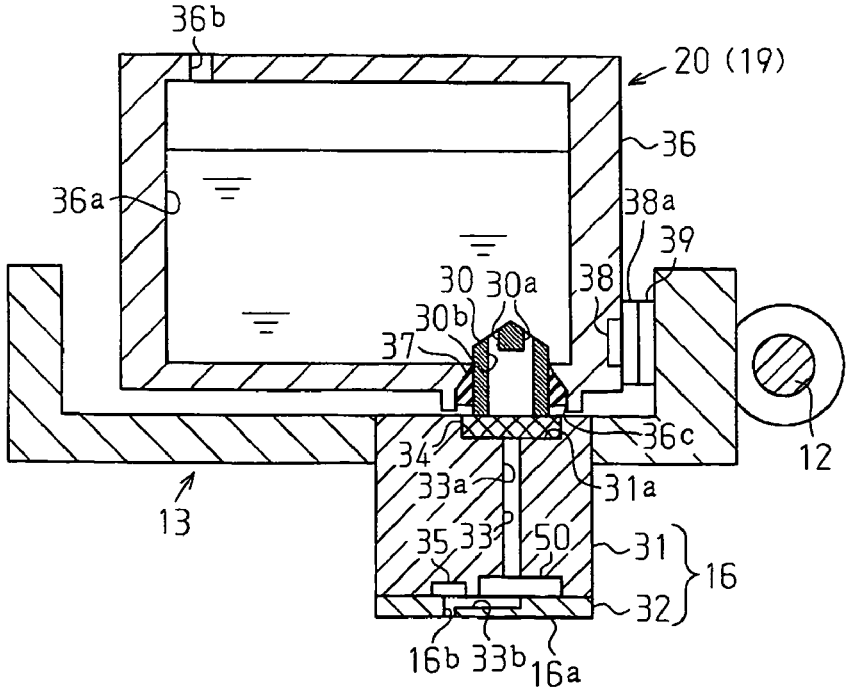
FIG. 2 is a schematic cross-sectional view of the cartridge and carriage shown in FIG. 1.

FIG. 2 is a schematic cross-sectional view of the cartridge 20 and carriage 13 of FIG. 1. The color cartridge 20 will now be described as an example. As shown in the drawing, a hollow supply needle 30 (guide needle) is arranged on the upper surface of the carriage 13. The recording head 16 is attached to the bottom surface of the carriage 13. A guide hole 30*a* extends through the distal end of the supply needle 30, and a hollow flow passage 30*b* is in communication with the guide hole 30*a*.

The recording head 16 includes a case head 31 fixed to the bottom surface of the carriage 13, and a head chip 32 fixed to the bottom surface of the case head 31. A filter 34, which prevents foreign matter in the ink flowing into the flow passage 30*b* of the supply needle 30 from entering a flow passage 33 of the recording head 16, is arranged in a recess 31*a* formed in the upper surface of the case head 31.

A valve unit 50 is provided above the head chip 32 at a position corresponding to the flow passage 33. The flow passage 33 includes an upstream flow passage 33*a*, which extends between the valve unit 50 and the supply needle 30, and a downstream flow passage 33*b*, which extends between the valve unit 50 and the nozzles 16*b*. The valve unit 50 functions as a pressure reducing valve for maintaining the liquid pressure of the ink within the downstream flow passage 33*b* at a predetermined value. The valve unit 50 is built into the recording head 16. In the first embodiment, the valve unit 50 reduces the pressure of the ink within the upstream flow passage 33*a* to atmospheric pressure (approximately 1 atm) and maintains the pressure of the ink within the downstream flow passage 33*b* at a predetermined negative pressure that is less than the atmospheric pressure. The downstream flow passage 33*b* is connected to a reservoir 65 (shown in FIG. 5). The reservoir 65 is in communication with each of ink chambers 68 (shown in FIG. 5) in which are respectively arranged piezoelectric oscillators 35 through a plurality of branching flow passages, the quantity of which is the same as the quantity of the nozzles 16*b* branching from the reservoir 65. Each ink chamber 68 is in communicates the nozzles 16*b* (nozzle holes) that open in the nozzle formation surface 16*b*. Ink droplets are ejected (discharged) from the nozzles 16*b* when drive voltage (pulse voltage) is applied to the piezoelectric oscillators 35 on the head chip 32.

The cartridge 20 includes a case 36 and stores ink in a storage tank 36*a* defined in the case 36. An atmospheric communication hole 36*b*, which communicates the atmosphere outside the case 36 and the storage tank 36*a*, extend through the upper portion of the case 36. Therefore, pressure applied to the ink stored in the storage tank 36*a* is about the same as the atmospheric pressure. When the cartridge 20 is mounted on the carriage 13, the supply needle 30 extends through a rubber packing 37 arranged in a supply port 36*c* of the cartridge 20. Then, ink, which is under atmospheric pressure, flows from the storage tank 36*a* through the guide hole 30*a* of the supply needle 30 and into the flow passage 30*b*. The ink passes through the filter 34 and flows into the flow passage 33.

In the prior art, ink maintained at a predetermined negative pressure, which is less than the atmospheric pressure, is supplied from the cartridge to the filter by a differential pressure valve built into the cartridge. In comparison, the first embodiment reduces the pressure of the ink after the ink passes through the filter 34 with the compact valve unit 50 arranged on the head chip 32. In the first embodiment, the ink is under atmospheric pressure when passing through the filter 34.

A circuit board 38 (cartridge IC) and connector terminal 38*a* are arranged beside the cartridge 20. When the cartridge 20 is mounted on the carriage 13, the connector terminal 38*a* is electrically connected to a contact terminal 39 of the carriage 13. The recording device 10 includes a CPU (not shown in the drawing) that functions as a controller. The CPU reads data from and writes data to a semiconductor memory element mounted in the circuit board 38. Various types of cartridge information data are stored in the semiconductor memory element, including the type of ink, serial number, ink consumption, valid period, and the like of the cartridge 20. The black cartridge 19, which also includes a storage tank 36*a* and a supply port 36*c*, has the same structure as the color cartridge 20.

Figure 3:
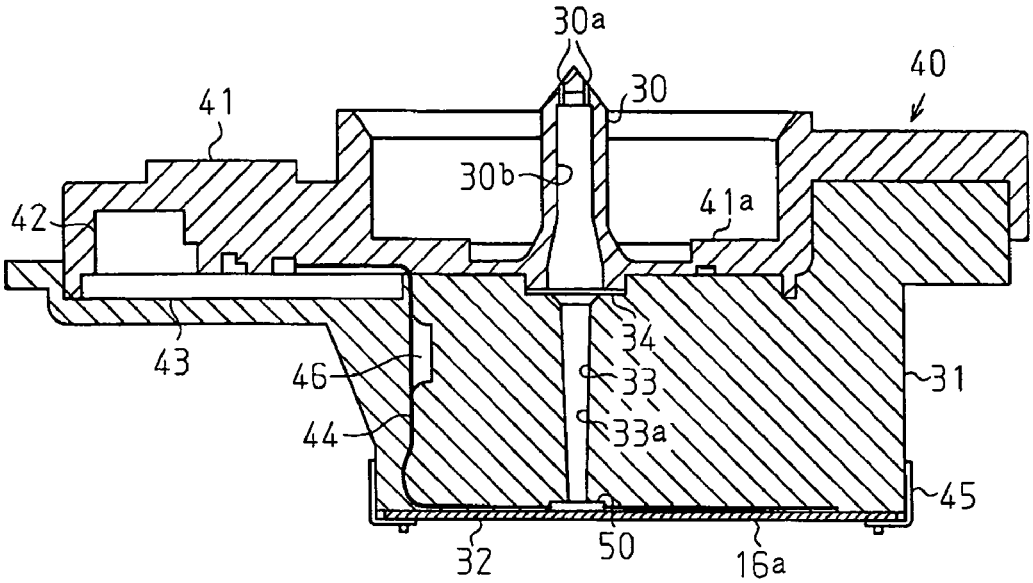
FIG. 3 is a schematic cross-sectional view of the recording head (head unit) of FIG. 2.

FIG. 3 is a schematic cross-sectional view of the recording head 16 shown in FIG. 2. FIG. 3 shows a cross-section taken along a plane parallel to the sub-scanning direction Y and extending through the supply needle 30 of FIG. 2.

As shown in FIG. 3, the supply needle 30 and recording head 16 are integrally assembled as a single head unit 40 in the carriage 13. The head unit 40 has a needle cartridge 41, which includes the supply needle 30, a case head 31, and a head chip 32. The needle cartridge 41 and case head 31 are joined with each other by performing, for example, welding or fitting.

The needle cartridge 41 includes a cavity 41*a* and the supply needle 30. The cavity 41*a* has a circular opening into which the supply port 36*c* of the cartridge 20 can be inserted. The supply needle 30 projects from the central part of the bottom surface of the cavity 41*a*. A filter 34 is arranged between the flow passage 30*b* formed in the supply needle 30 and the flow passage 33 formed in the case head 31 at the location where the needle cartridge 41 and the case head 31 are joined with each other. An FFC connector 42 and a head circuit board 43, to which the FFC connector 42 is connected, is arranged at the distal end of the needle cartridge 41 (left end in the drawing) at the location where the needle cartridge 41 and the case head 31 are joined with each other. Part of the FFC connector 42 is exposed from the head unit 40. An FFC (flexible flat cable, not shown in the drawing) extending from the controller in the body frame 11 is electrically connected to the FFC connector 42. Therefore, signals and data are transmitted and received between the controller and the head circuit board 43 via the FFC. Various kinds of sensors for obtaining the necessary detection information and various electronic circuits necessary to control the actuation of the recording head 16 are installed on the head circuit board 43.

An FPC 44 (flexible printed circuit), which extends from the head circuit board 43, is electrically connected to the head chip 32, which is held by a cover head 45 on the bottom surface of the case head 31. An actuator drive control head IC 46 (driver IC) for controlling the piezoelectric oscillator 35 is connected to the FPC 44. The head IC 46 includes a driver circuit for generating a discharge drive pulse (drive voltage) to drive each piezoelectric oscillator 35. A discharge drive pulse is generated for each nozzle 16*b* and provided to the corresponding piezoelectric oscillator 35 (refer to FIG. 2). The valve unit 50 is arranged at a position corresponding to the flow passage 33*a* formed within the case head 31 at the upper surface of the head chip 32.

Figure 4A:
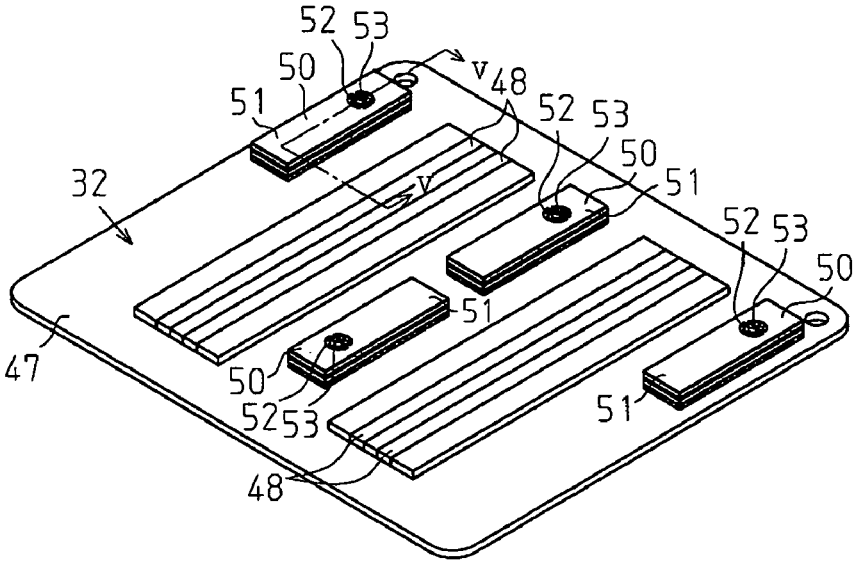
FIG. 4A is a schematic perspective view showing the head chip of FIG. 2.
Figure 4B:
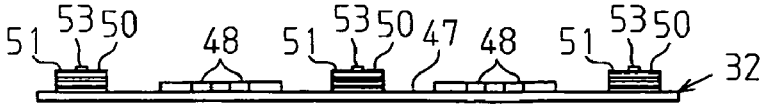
FIG. 4B is a side view showing the head chip of FIG. 4A.

FIG. 4A is a perspective view showing the head chip 32 of FIG. 3, and FIG. 4B is a side view showing the head chip 32.

The head chip 32 includes a laminate substrate 47. Four actuators 48 and four valve units 50 are mounted on the substrate 47.

The valve unit 50 includes laminate bodies 51, which serve as main bodies, input ports 52 that are in communication with openings in the upper surface of the laminate body 51, and valves 53 arranged in the input ports 52. The input ports 52 are in communication with the upstream flow passage 33*a* within the case head 31. The ink, which is maintained at atmospheric pressure and has flowed through the filter 34 to the flow passage 33*a*, flows from the flow passage 33*a* into the input ports 52. The valve 53 includes a pressure reducing valve mechanism, and maintains the ink within the downstream flow passage 33*b* formed within the substrate 47 at a predetermined negative pressure with a pressure reducing valve.

The actuator 48 is formed as a thin layer that includes a plurality of nozzles 16*b* (for example, 80 to 180 nozzles) corresponding to the color of ink and the same number of piezoelectric oscillators 35. The piezoelectric oscillators 35 are aligned in a row at positions corresponding to the nozzles 16*b*. The downstream flow passage 33*b* formed in the substrate 47 is in communication with the reservoir 65 corresponding to the valve unit 50 and a plurality of ink chambers 68 through a plurality of branch flow passages, the quantity of which is the same as the quantity of the nozzles 16*b*, branching from the reservoir 65. The piezoelectric oscillators 35 are arranged at positions corresponding to the ink chamber 68 on the upper surface of the substrate 47. In the first embodiment, the valve unit 50 has a thickness of approximately 1 mm, and the actuator 48 has a thickness of approximate of 0.3 mm. The body of the valve unit 50 built into the recording head 16 preferably has a thickness that is less than 2 mm. However, the thickness of the body of the valve unit 50 may be modified in accordance with the intended purpose.

Figure 5:
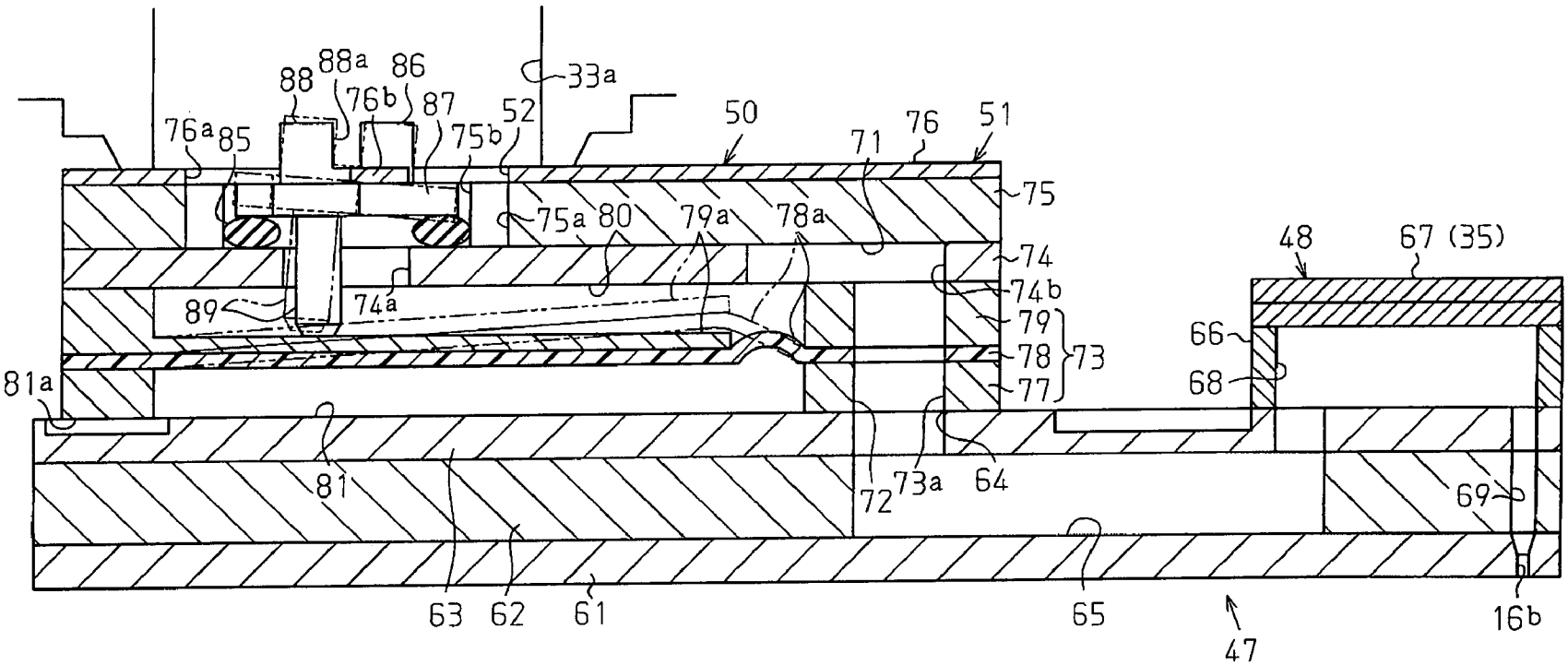
FIG. 5 is a cross-sectional view of the head chip taken along line V-V line in FIG. 4A.

FIG. 5 is a cross-sectional view of the head chip 32 taken along line V-V in FIG. 4A. The substrate 47 has a three-layer structure including a nozzle plate 61, a flow passage plate 62, and a supply plate 63 that are laminated and bonded together with an adhesive. An ink supply port 64 is formed in the upper surface of the substrate 47, and the valve unit 50 is mounted so as to cover the ink supply port 64. The ink supply port 64 is in communication with the reservoir 65. A partition layer 66 formed of an insulating material is arranged on the upper surface of the substrate 47. A piezoelectric layer 67, which functions as the piezoelectric oscillator 35 of the actuator 48, is laminated on the partition layer 66. An ink chamber 68 is formed by the space surrounded by the partition layer 66 and piezoelectric layer 67. A nozzle hole 69, which is in communication with the ink chamber 68, is formed in the substrate 47. In the nozzle hole 69, the part formed in the nozzle plate 61 defines the nozzle 16*b*.

The flow passage plate 62 may have a plurality of branch flow passages, which branch from the reservoir 65, and a plurality of through holes, which respectively function as ink chambers that are in communication with the branch flow passages. The through holes are formed, for example, by performing etching. That is, a plurality of branch flow passages and ink chambers may be formed between the supply plate 63 and the nozzle plate 61 laminated on both sides of the flow passage plate 62. In this case, the thin piezoelectric layer on the upper surface of the supply plate may be formed by performing a CVD method or a PVD method such as spattering or the like. Therefore, extremely small piezoelectric oscillators 35 may be formed. Moreover, it is desirable that the piezoelectric layer includes a piezoelectric material layer and two electrode layers sandwiching the piezoelectric layer.

The structure of the valve unit 50 will now be described. The laminate body 51 of the valve unit 50 is a flow passage 71 that communicated between the input port 52 communicating with the opening on the upper surface of the laminate body 51 and an output port 72 that is in communication with the opening on the bottom surface of the laminate body 51. The valve unit 50 is provided on the substrate 47 such that the output port 72 is in communication with the ink supply port 64.

The laminate body 51 includes a laminate layer film plate 73 serving as a plurality of plate members, a flow passage plate 74, a valve holding plate 75, and a valve anchor plate 76. The flow passage plate 74 and valve holding plate 75 are formed of metal or ceramic. For example, a glass substrate or silicon substrate (silicon wafer) may be used in the first embodiment. The valve anchor plate 76 is preferably formed of an elastic metal material so that it applies an urging force to a valve body 86. In the first embodiment, stainless steel (SUS) may be used.

The laminate layer film plate 73 functions as the first plate member of the present invention. The laminate layer film plate 73 includes a plurality of sub plates. In the first embodiment, the laminate layer film plate 73 includes a film 78 (first sub plate), a plate 79 (second sub plate), and a plate 77 (third sub plate). The plate 77 and the plate 79 are formed, for example, of stainless steel (SUS), and the film 78 is formed of, for example, a resin material. The film 78 is desirably formed of a resin material having particularly low gas permeability. The reason being that resin materials are generally highly permeable to gas compared to other materials. Therefore, the plates 77 and 79 are preferably formed of a material other than resin to reduce gas permeability, that is, material such as metal or an inorganic material. It is particularly desirable that the plate 79, which includes a pressure receiving plate 79*a*, is formed of a metal material. In the case of metals, various metals such as iron, copper, aluminum, nickel, and the like may be used instead of SUS. In this case, the material must have a corrosion resistance (chemical resistance) against the liquid used. Therefore, when metal is used, it is desirable that the surface is plated to increase corrosion resistance. In the case of iron, for example, the material may be provided with nickel plating or zinc plating.

The valve unit 50 includes a pressure receiving plate 79*a* formed in the central portion of the laminate layer film plate 73. Specifically, the pressure receiving plate 79*a* is formed by the plate 79, and the basal end of the pressure receiving plate 79*a* is supported by the plate 79. The distal end of the pressure receiving plate 79*a* is free. The valve unit 50 further includes a film 78*a* (refer to FIG. 6) that circumscribes, in an approximate U-shape, the perimeter of the pressure receiving plate 79*a* in order to ensure the amount of deformation of the pressure receiving plate 79*a*. The film 78*a* functions as a drive portion in the present invention. The film 78*a* is formed by the film 78. A fluid pressure chamber 80 (first pressure chamber) and atmospheric pressure chamber 81 (second pressure chamber) are partitioned by the pressure receiving plate 79*a* and film 78*a* inside the valve unit 50. The fluid pressure chamber 80 functions as part of the flow passage 71. The atmospheric pressure chamber 81 is open to the exterior (atmosphere) of the valve unit 50 through an atmospheric communication hole 81*a* that is in communication with the atmosphere. Therefore, the atmospheric pressure chamber 81 is normally maintained under atmospheric pressure. The pressure receiving plate 79*a* receives a force that is in accordance with the pressure difference between the atmospheric pressure of the atmospheric pressure chamber 81 and the liquid pressure (ink pressure) of the fluid pressure chamber 80. For example, when the liquid pressure is less than the atmospheric pressure, the pressure receiving plate 79*a* receives force that displaces the pressure receiving plate 79*a* into the fluid pressure chamber 80, as indicated by the dotted lines in FIG. 5.

The flow passage plate 74 functions as the second plate member of the present invention. The flow passage plate 74 includes two through holes 74*a* and 74*b* as part of the flow passages 71. An annular seal member 85 (O-ring) formed of rubber is arranged on the upper surface of the flow passage plate 74 so as to circumscribe the through hole 74*a* that is in communication with the fluid pressure chamber 80. The valve holding plate 75 includes a through hole 75*a* that accommodates the valve body 86 and seal member 85.

The valve body 86, which is an example of the valve 53, includes a discoid valve plate portion 87 that functions as a valve portion, a cylindrical head portion 88 that projects perpendicularly from the upper surface of the valve plate portion 87, and a shaft portion 89 that projects perpendicularly from the bottom surface of the valve plate portion 87. The shaft portion 89 functions as the transmission portion of the present invention. The shaft portion 89 is eccentric by a predetermined offset amount relative to the axis of the valve body 86. The seal member 85 functions as a valve seat. The valve plate portion 87 closes the valve body 86 when the valve plate portion 87 abuts the entire upper surface of the seal member 85. In a valve closed state, the axis of the valve body 86 coincides with the axial center of the seal member 85.

The valve anchor plate 76 functions as the third plate member of the present invention. The valve anchor plate 76 urges the valve body 86 in a direction that the valve body 86 is pressed against the seal member 85. Therefore, the valve body 86 is held (fixed) by the valve anchor plate 76. Specifically, the upper surface of the valve plate portion 87 of the valve body 86 abuts against a plate spring 76*b* of the valve anchor plate 76, and the valve body 86 is forced downward by the elastic force of a plate spring 76*b*. Therefore, the bottom surface of the valve plate portion 87 is pressed against the seal member 85, and the valve body 86 is maintained in a closed state in which the flow passage 71 (through hole 74*a*) is blocked. Furthermore, the plate spring 76*b* abuts against the valve plate portion 87 at a position that is opposite the direction in which the shaft portion 89 is eccentric to the axis of the seal member 85. The shaft portion 89 of the valve body 86 is inserted into the through hole 74*a* and projects into the fluid pressure chamber 80. The lower end of the shaft portion 89 comes into contact with the basal upper surface of the pressure receiving plate 79*a*.

When the piezoelectric oscillator 35 is actuated, liquid droplets are discharged from the nozzle 16*b*. Then, the liquid pressure within the fluid pressure chamber 80 falls as the amount of liquid decreases in the flow passage 33*b*. As a result, a force is produced to displace the pressure receiving plate 79*a* toward the inside of the fluid pressure chamber 80 so as to push the valve body 86 of the shaft portion 89 upward with the pressure difference between the atmospheric pressure and fluid pressure within the fluid pressure chamber 80. When the force exceeds the force of the plate spring 76*b* that urges the valve body 86 downward, the pressure receiving plate 79*a* is displaced upward so as to lift the shaft portion 89 of the valve body 86. Thus, the pressure receiving plate 79*a* pivots and inclines about the basal portion supported by the plate 79, as indicated by the double dashed line in FIG. 5. The shaft portion 89 of the valve body 86 abuts against the upper surface of the basal end (near the pivot point) of the pressure receiving plate 79*a*. Therefore, the shaft portion 89 is raised so as to incline in an upward direction with a leftward inclination as shown in FIG. 5 by the force received from the pressure receiving plate 79*a*. That is, the valve body 86 pivots at a position abutting against the plate spring 76*b* so as to be inclinable by a predetermined angle. Then, the direction in which the shaft portion 89 receives the force from the pressure receiving plate 79*a* (upward direction with leftward inclination in FIG. 5) corresponds to the inclination direction of the valve body 86. As a result, a space is formed between the valve plate portion 87 and the seal member 85, which opens the valve unit 50.

Figure 6:
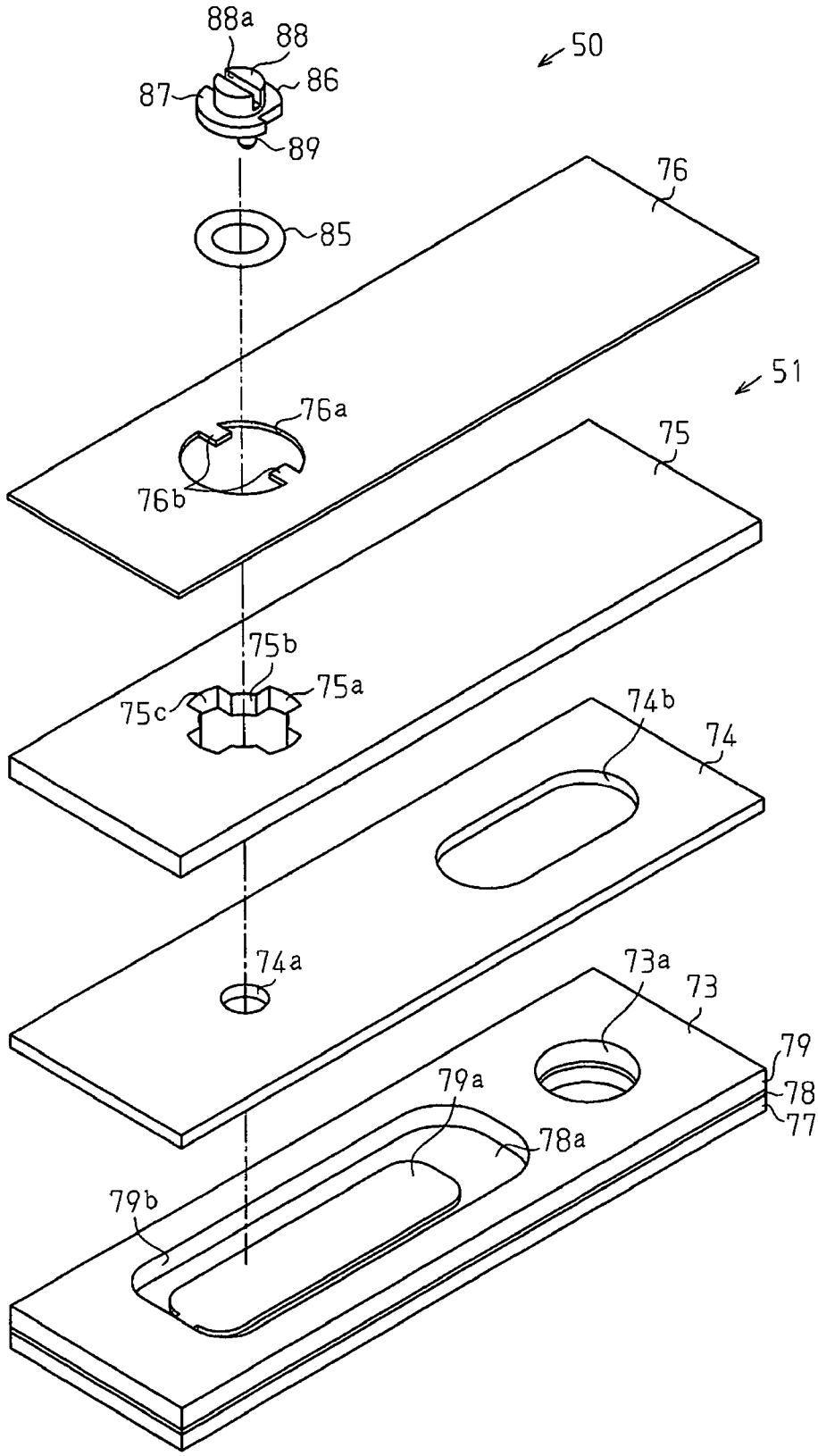
FIG. 6 is a schematic exploded perspective view showing the valve unit of FIG. 5.

FIG. 6 is an exploded perspective view of the valve unit 50 of FIG. 5. As previously mentioned, the valve unit 50 includes the laminate layer film plate 73, flow passage plate 74, valve holding plate 75, valve anchor plate 76, seal member 85, and valve body 86. The laminate layer film plate 73 has a three-layer structure that includes the plates 77, 78, and 79. The plates 77 and 79 and the film 78 are adhered with an adhesive. The pressure receiving plate 79*a* and film 78*a* are formed through the manufacturing procedures described below using the laminate layer film plate 73 before it is processed.

First, a photoresist is applied to one side (front surface) of the preprocess laminate layer film plate 73. Then, the patterns of the cavity 79*b* and through hole 73*a* are formed by performing exposure and development on predetermined regions in the surface of the laminate layer film plate 73. The cavity 79*b* is patterned in a region corresponding to the fluid pressure chamber 80. Next, a photoresist functioning as a mask is applied to the region outside the patterns of the cavity 79*b* and through hole 73*a*. Thereafter, a photoresist is applied to the other side (rear surface) of the laminate layer film plate 73. Subsequently, the pattern of the atmospheric pressure chamber 81 is formed by performing exposure and development on a predetermined region at the rear side of the laminate layer film plate 73. Next, a photoresist that functions as a mask is applied to the region outside the pattern of the atmospheric pressure chamber 81. Then, the laminate layer film plate 73 is immersed in an etching liquid for a predetermined time and both surfaces of the laminate layer film plate 73 are etched (first etching process). In the first etching process, the plate 79 is etched so that the thickness of the bottom surface of the cavity 79*b* is approximately the same as the pressure receiving plate 79*a*. Furthermore, the plate 77 is etched to the same depth as the plate 79 in the pattern region of the atmospheric pressure chamber 81 in the first etching process.

Then, a photoresist is applied to the bottom surface of the cavity 79*b* having a predetermined depth formed in the plate 79. Next, the pattern of the film 78*a* is formed by performing exposure and development on a predetermined region within the cavity 79*b*. Next, a photoresist functioning as a mask is applied to the region outside the pattern of the film 78*a*. The plate 77 (rear surface of the laminate layer film plate 73) employs the mask used in the first etching process. Then, the laminate layer film plate 73 is immersed in an etching liquid for a predetermined time and the laminate layer film plate 73 (plate 77 and cavity 79*b* of the plate 79) is etched (second etching process). The bottom surface of the cavity 79*b* is etched into a generally U-shape during the second etching process. As a result, the fluid pressure chamber 80 is formed, and the film 78*a* (film 78) is exposed within the fluid pressure chamber 80. Furthermore, the plate 77 is etched to the same depth as the plate 79 by the second etching process. As a result, the atmospheric pressure chamber 81 is formed, and the film 78*a* (film 78) is exposed within the atmospheric pressure chamber 81. Furthermore, the resin material film 78 is etched by the etching fluid of the plates 77 and 79. Therefore, an etching time sufficient for exposure of the film 78 is ensured in the second etching process.

Thus, the film 78*a* is formed by the second etching process in which the cavity 79*b* is etched into a generally U-shape. That is, the residual portion of the bottom surface of the cavity 79*b* that has been etched in the second etching process forms the pressure receiving plate 79*a*. Furthermore, only the film 78 remains in the patterned region of the through hole 73*a*. Thereafter, the laminate layer film plate 73 is washed to remove the photoresist used as a mask in the first and second etching processes.

Then, one side of the laminate layer film plate 73 is hermetically sealed by a jig, which injects pressurized air. In this state, atmospheric pressure is injected from the jig so that plastic deformation occurs in the film 78*a*. The pressure injection is performed after the laminate layer film plate 73 has been heated to a temperature above the glass transition point of the resin material of the film 78. Thus, the film 78*a* retains a flexed shape after the plastic deformation. The pressure receiving plate 79*a* may be displaced by a necessary amount by having such flexure in the film 78*a*. Thereafter, the film 78 that remains in the region of the through hole 73*a* is removed to form the through hole 73*a*. Of course, the removal of the of the film 78 remaining in the region of the through hole 73*a* may also be accomplished before the pressurized air process insofar as there is no adverse effect from pressure leakage or the like.

The method of imparting flexure to the film 78*a* is not limited to the injection of pressurized air. For example, the film 78*a* may also be mechanically subjected to plastic deformation by pressing the exposed film 78*a* against a generally U-shapes mold having a by a mold pressing jig. Furthermore, water or other liquids may be injected instead of pressurized air. A sandblast method for blasting processing particles may also be used. The film 78*a* may also be flexed by the energy generated by impinging molecules through sputtering. Although the force of the processing means (pressurized air, particles, jig, and the like) used to flex the film 78 is preferably imparted only to the film 78*a*, the force of the processing means may also be imparted to the entirety of the pressure receiving plate 79*a* and the cavity 79*b* of the film 78*a*.

A manufacturing sequence of sandwiching the flexed film with SUS beforehand may also be performed as another method of manufacturing the laminate layer film plate 73. In this case, however, it is difficult to position the flexed part of the film at the through hole of the SUS. Conversely, the first embodiment employs a laminate layer film plate 73 having a triple layer structure in which the film 78 is sandwiched in the center layer. After the film 78 undergoes exposure, the exposed film 78 is flexed. In this manufacturing procedure, the flexing of the film 78 at a desired position is ensured.

In the first embodiment, the flow passage plate 74 and valve holding plate 75 may be formed by a single plate. The through hole 74*a*, into which the shaft portion 89 is inserted, and the through hole 75*a* that accommodates the valve body 86 and seal member 85 may also be formed by a single plate. In this case, the through holes 74*a* and 75*a* are formed by half-etching both sides of a single plate.

The flow passage plate 74 is formed of a metal material or inorganic material. The flow passage plate 74 is formed of, for example, SUS in the first embodiment, and the two through holes 74*a* and 74*b* are formed by etching an SUS plate. The through hole 74*a* is formed such that the shaft portion 89 of the valve body 86 abuts against a position near the basal end of the pressure receiving plate 79*a*. The through hole 74*b* is slot that is in communication with both the through hole 73*a* and a recess 78*b*.

The valve holding plate 75 is formed by a metal material or inorganic material. The valve holding plate 75 is formed of, for example, SUS in the first embodiment, and the through hole 75*a* is formed at a position facing the through hole 74*a* so as to have a generally cross-shaped opening. At least either one of the flow passage plate 74 and valve holding plate 75 may also be formed of glass or silicon (Si).

The valve anchor plate 76 is formed of metal material so that the plate spring 76*b* has a predetermined elasticity coefficient. The valve anchor plate 76 is formed of, for example, SUS in the first embodiment. The through hole 76*a* is formed at a position facing the through hole 75*a*. A pair of plate springs 76*b* project from the valve anchor plate 76 and extend inward so as to face towards each other from the perimeter of the through hole 76*a*.

The seal member 85 has an inner diameter, which is larger than the outer diameter of the through hole 74*a*, and an outer diameter, which is greater than the inner diameter of the through hole 75*a*.

The valve body 86 includes the valve plate portion 87, a head portion 88, and a shaft portion 89. The valve plate portion 87 functions as a valve portion of the seal member 85, which functions as a valve seat. When the plate spring 76*b* applies an urging force to the valve body 86, the shaft portion 89 is abuttable against the upper surface of the pressure receiving plate 79*a* through the through hole 74*a*.

The laminate layer film plate 73, flow passage plate 74, valve holding plate 75, and valve anchor plate 76 are each formed so as to have a total thickness of approximately 1 mm when the four layers have been laminated. Preferably, the laminate layer film plate 73 has a thickness of, for example, 0.1 to 0.6 mm, the flow passage plate 74 has a thickness of, for example, 0.02 to 0.2 mm, the valve holding plate 75 has a thickness of, for example, 0.05 to 0.4 mm, and the valve anchor plate 76 has a thickness of, for example, 0.02 to 0.2 mm. The thickness of each thin plate is set in accordance with various conditions, such as the size of the valve body 86 and seal member 85 and the required length in the thickness direction of the flow passage.

Figure 7A:
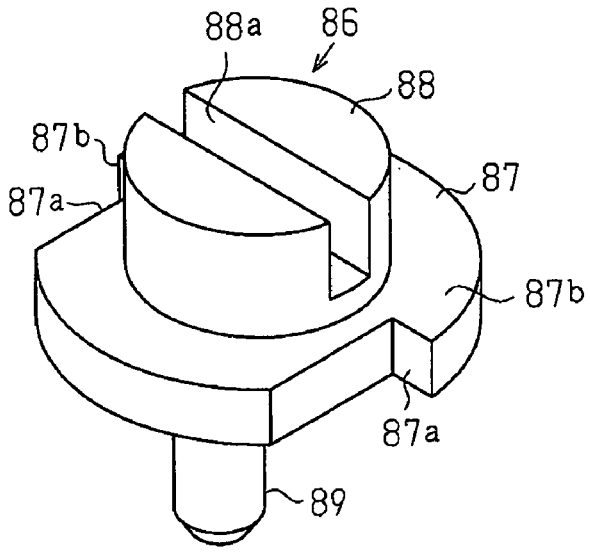
FIG. 7A is a schematic perspective view showing the head portion of the valve of FIG. 6.
Figure 7B:
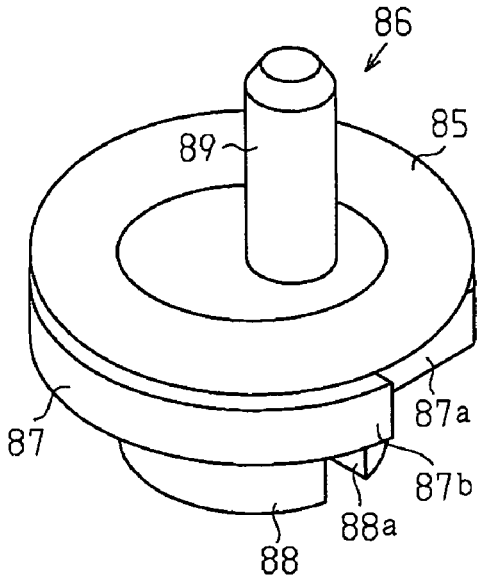
FIG. 7B is a schematic perspective view showing the valve axis portion and seal member of FIG. 6.
Figure 7C:
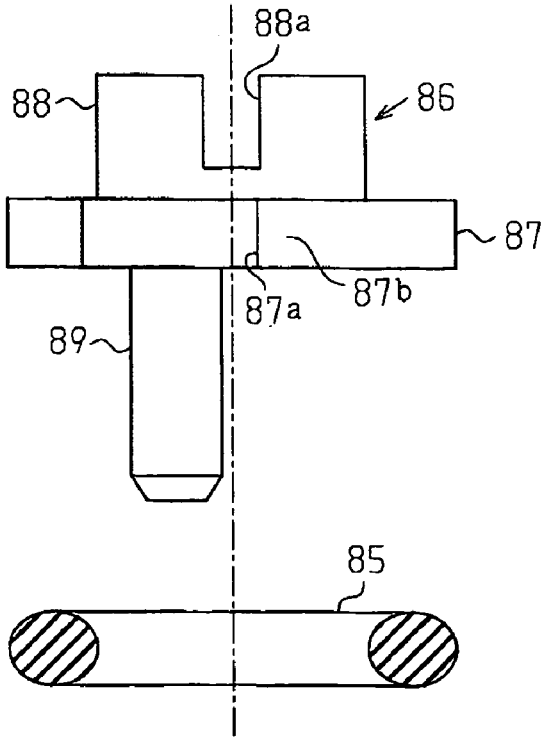
FIG. 7C is a schematic side view showing the valve and seal member of FIG. 6.

FIG. 7A is a perspective view showing the head portion 88 of the valve body 86 of FIG. 6. FIG. 7B is a perspective view showing the shaft portion 89 and seal member 85 of the valve body 86. FIG. 7C is a side view showing the valve body 86 and seal member 85. The head portion 88 of the valve body 86 has a groove 88*a* that extends across the center of the upper surface. The distal end of a tool, such as precision driver or the like, is inserted into the groove 88*a* when the valve body 86 is assembled on the laminate body 51. The valve plate portion 87 has two cutaway recesses 87*a* having line symmetry and formed by cutting away parts of the circumferential surface. A projection 87*b* is formed by the remaining part of the circumferential surface. The valve plate portion 87 has a shape having line symmetry when viewed from above the head portion 88 (refer to FIG. 9). As shown in FIG. 7C, the axis of the valve plate portion 87 matches the axis of the head portion 88. As shown in FIG. 7B, the surface that has the shaft portion 89 of the valve plate portion 87 abuts against the seal member 85, and the valve body 86 closes the flow passage when this surface is in contact with the seal member 85.

The axis of the shaft portion 89 is eccentric by a predetermined offset amount relative to the axis (axial center of the seal member 85 indicated by the single dashed line in FIG. 7C) of the generally discoid valve plate portion 87. The projection 87*b* is formed on the side opposite the shaft portion 89 relative to the axis (axial center of the seal member 85) of the valve body 86, as shown in FIG. 7C. The plate spring 76*b* abuts against the projection 87*b*. Therefore, when the shaft portion 89 of the valve body 86 is raised by the force from the pressure receiving plate 79*a*, the valve body 86 is tilted upward with a leftward inclination by the urging force of the plate spring 76*b* that downwardly pushes the projection 87*b*. The axis of the valve plate portion 87 (that is, the axial center of the valve body 86) coincides with the center (center of the ring) of the seal member 85.

Figure 8A:
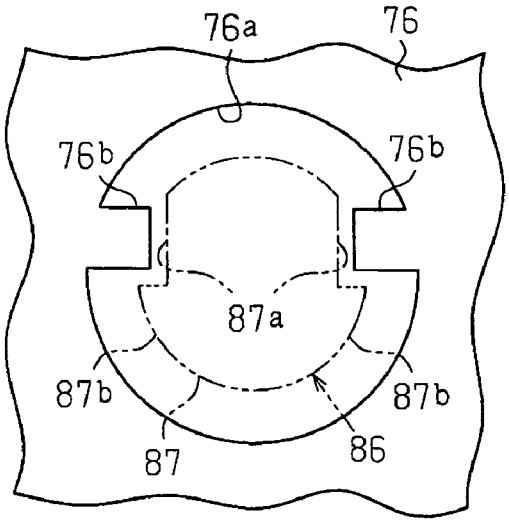
FIG. 8A is a schematic plan view showing the through hole of the valve mounting plate of FIG. 6.
Figure 8B:
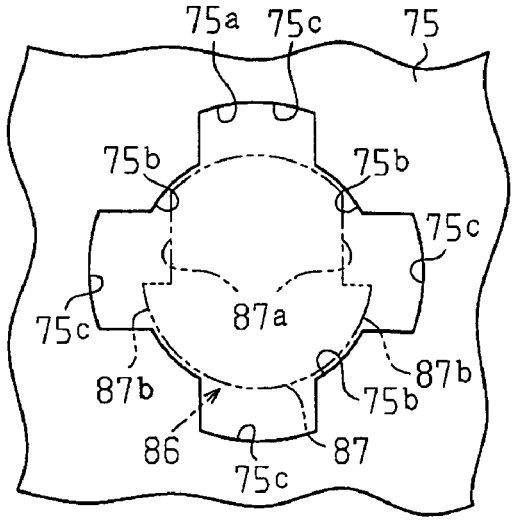
FIG. 8B is a schematic plan view showing the through hole of the valve holding plate of FIG. 6.

FIG. 8A is a plan view showing the through hole 76*a* of the valve anchor plate 76 of FIG. 6. FIG. 8B is a plan view showing the through hole 75*a* of the valve holding plate 75 of FIG. 6. As shown in FIG. 8A, the two plate springs 76*b* extend inwardly from the inner circumferential surface defining the through hole 75*a* so as to face towards each other along a line parallel to the radial direction and shifted by a predetermined offset amount from the center of the through hole 76*a* (center of the seal member 85). When the cutaway recess 87*a* faces the plate spring 76*b* (indicated by the dashed line in FIG. 8A), the plate spring 76*b* does not abut against the projection 87*b* of the valve body 86. When the valve body 86 is assembled, the valve body 86, which is in the above described state, is inserted into the through hole 75*a* through the through hole 76*a*.

As shown in FIG. 8B, the generally cross-shaped through hole 75*a* has four recesses extending outwardly at ninety degree intervals in the circumferential direction, and four inner wall surfaces 75*b* connected between the four recesses 75*c* and having an inner diameter smaller than that of the recesses 75*c*. The outer diameter of the valve plate portion 87 is somewhat smaller than the inner diameter of the inner wall surface 75*b*. Therefore, the valve plate portion 87 is insertable in the through hole 75*a*. The outer diameter of the seal member 85 is somewhat larger than the inner diameter of the inner wall surface 75*b*. Therefore, the seal member 85 can be pressed into the inner wall surface 75*b* of the through hole 75*a*. Thus, the seal member 85 is positioned within the through hole 75*a* coaxially with the through hole 74*a*.

Figure 9A:
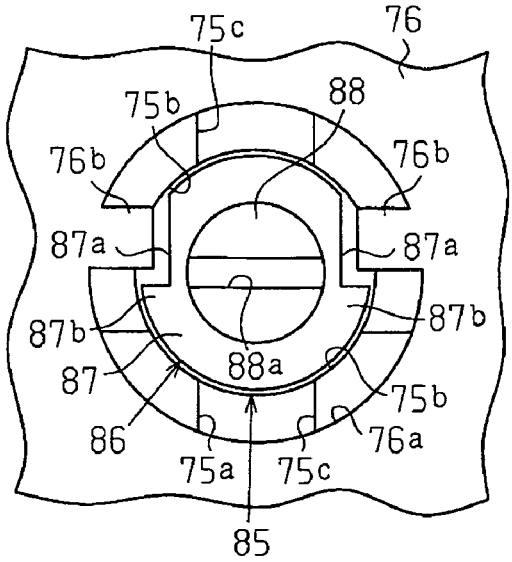
FIG. 9A is a plan view showing the method of assembling the valve to the laminate body of FIG. 6.
Figure 9B:
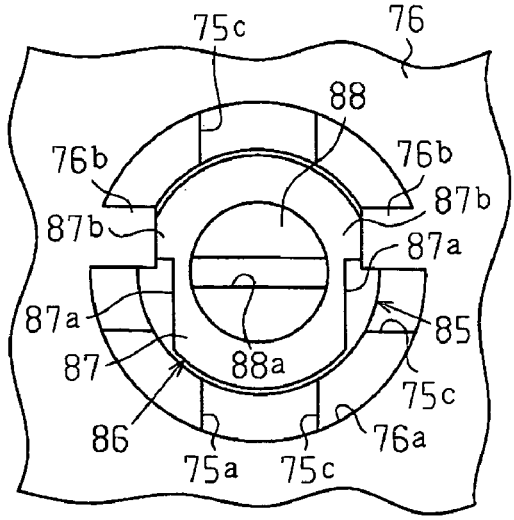
FIG. 9B is a plan view showing the method of assembling the valve to the laminate body of FIG. 6.

FIGS. 9A and 9B show the procedures for assembling the valve body 86 on the laminate body 51 of FIG. 6. First, the valve body 86 is inserted in the through hole 76*a* with the cutaway recess 87*a* positioned to face the plate spring 76*b*, as shown in FIG. 9A. The seal member 85 has already been pressed into the through hole 75*a* when the valve body 86 is assembled. Then, the seal member is pressed by the valve body 86, and the upper surface of the valve plate portion 87 is pushed below the bottom surface of the plate spring 76*b*. Next, the distal end of a tool such as a precision driver (slot type driver) or the like is inserted into the groove 88*a* and rotated by one half of a rotation. As a result, the upper surface of the projection 87*b* of the valve plate portion 87 abuts against the bottom surface of the plate spring 76*b*, as viewed in FIG. 9B. In this state, the valve body 86 is urged downward (downward with respect to a direction perpendicular to the plane of FIG. 9B) by the elastic force of the plate spring 76*b*.

Figure 10A:
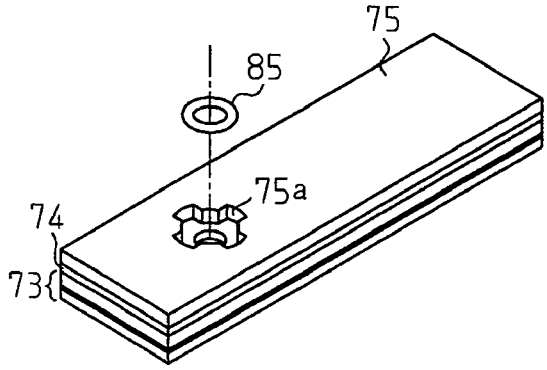
FIG. 10A is a perspective view showing the method of manufacturing the valve unit of FIG. 6.
Figure 10B:
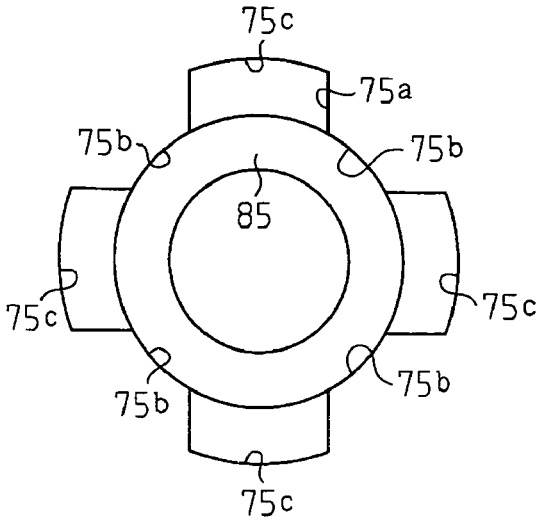
FIG. 10B is a perspective view showing the method of manufacturing the valve unit of FIG. 6.
Figure 10C:
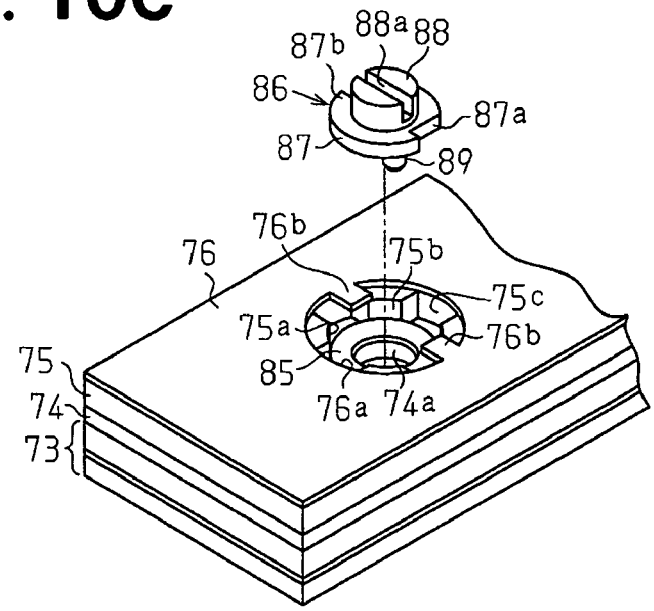
FIG. 10C is a perspective view showing the method of manufacturing the valve unit of FIG. 6.

FIGS. 10A through 10D show the procedures for manufacturing the valve unit 50 of FIG. 6. As shown in FIG. 10A, the three layers of the laminate layer film plate 73, flow passage plate 74, and valve holding plate 75 are first adhered together with an adhesive. Then, the seal member 85 is inserted into the through hole 75*a*. The seal member 85 is positioned by the inner wall surface 75*b* of the through hole 75*a*, as shown in FIG. 10B.

Figure 10D:
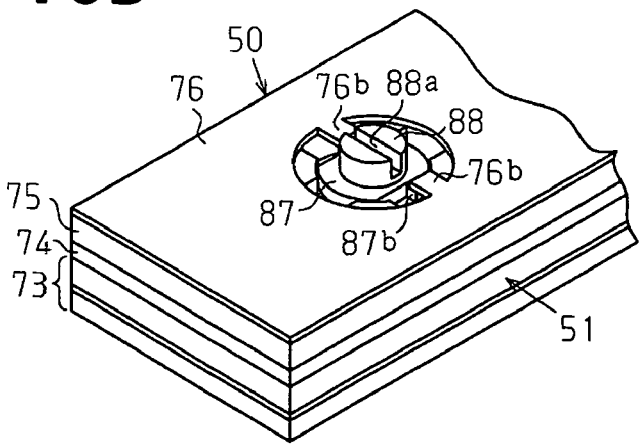
FIG. 10D is a perspective view showing the method of manufacturing the valve unit of FIG. 6.

Next, the valve anchor plate 76 is bonded to the upper surface of the valve holding plate 75 using an adhesive to complete the laminate body 51. The valve body 86 is then inserted in the through hole 76*a* of the laminate body 51. Then the valve body 86, which has been inserted into the through hole 76*a*, is rotated using a tool that engages the groove 88*a*, as shown in FIGS. 9A and 9B. This assembles the valve body 86 as shown in FIG. 10D. At this time, the seal member 85 and valve body 86 may be preassembled with the through holes 75*a* and 76*a* of the laminate body 51. In an actual manufacturing operation, a large mother laminate body would be manufactured to efficiently mass produce the valve unit 50. Then, the mother laminate body would be cut so as to simultaneously obtain a plurality of laminate bodies 51.

In the first embodiment, the valve unit 50 may be incorporated in a recording head 16 since the valve unit is ultra thin (ultra compact) and has a thickness of approximately 1 mm. Therefore, the ink pressure is equal to the atmospheric pressure until the ink in the cartridge 20 passes through the filter 34 and the upstream flow passage 33*a* and reaches the valve unit 50. That is, the ink is first subjected to pressure reduction by the valve unit 50 inside the recording head 16. There is therefore virtually no pressure difference inside and outside the cartridge 20. As a result, it is difficult for bubbles to be produced in the ink since gases such as nitrogen and oxygen can not readily permeate the resin material that forms the head unit 40 and cartridge 20. The ink pressure in the flow passage upstream from the filter 34 is equal to the atmospheric pressure between the cartridge 20 and the nozzle 16*b*. Therefore, minute bubbles are formed in the ink at a slow rate. Even if small bubbles form in the ink, they do not become large. Large bubbles are trapped in the filter 34. This substantially prevents the dynamic pressure of the ink from rising. As a result, the ink pressure (negative pressure) in the flow passage downstream from the filter 34, particularly, the ink pressure in the ink chamber 68, is prevented from becoming unstable. Thus, ink droplets of an appropriate amount are stably discharged.

Referring to FIG. 5, when there is no pressure difference between the fluid pressure chamber 80 and the atmospheric pressure chamber 81, the pressure receiving plate 79*a* is held at the position indicated by the solid lines in FIG. 5. Therefore, the valve plate portion 87 is in contact with the seal member 85. That is, the valve plate portion 87 is moved to a position closing the through hole 74*a* (ink flow passage). When ink droplets are discharged and the amount of ink within the ink chamber 68 and reservoir 65 decreases, the fluid pressure of the fluid pressure chamber 80 is reduced in accordance with the amount of this decrease. As a result, a pressure difference is produced between the fluid pressure chamber 80 and the atmospheric pressure chamber 81, and a force in accordance with the pressure differences acts on the pressure receiving plate 79*a*. When the force transmitted from the pressure receiving plate 79*a* to the valve body 86 becomes greater than the downward pressing force acting the closing direction of the valve body 86 (weight of the valve body 86 and the urging force of the plate spring 76*b*), the pressure receiving plate 79*a* is inclined so as to pivot about the basal portion and be displaced. The inclination lifts the shaft portion 89, which is abut against a position closer to the basal end of the pressure receiving plate 79*a*. As a result, the valve body 86 is inclined, and the valve plate portion 87 moves to an opening position for opening the through hole 74*a* (ink flow passage).

When the valve opens, ink in the upstream flow passage 33*a* flows into the valve unit 50 from the gap between the valve plate portion 87 and seal member 85. The ink pressure in the reservoir 65 and ink chamber 68 rises as the ink flows in such that the pressure difference between the fluid pressure chamber 80 and the atmospheric pressure chamber 81 decreases. Then, when the force transmitted from the pressure receiving plate 79*a* to the shaft portion 89 becomes less than the downward pressing force acting on the valve body 86 (weight of the valve body 86 and the urging force of the plate spring 76*b*), the pressure receiving plate 79*a* returns to its original position and the valve body 86 is lowered. This closes the valve. Therefore, the valve unit 50 repeatedly performs valve opening and valve closing. As a result, the ink pressure of the reservoir 65 and ink chamber 68 is stably maintained at a predetermined negative pressure, and an appropriate amount of ink droplets are discharged.

The recording device 10 including the valve unit 50 of the first embodiment has the advantages described below.

(1) An ultra thin valve unit 50 having a thickness of approximately 1 mm and functioning as a pressure reducing valve is provided by assembling the valve body 86 in the laminate body 51. This enables reduction in the size of printers (for example, compact and portable printers).

(2) The valve unit 50 is ultra compact and thus can be built into a recording head 16. Therefore, the same valve unit may be used in recording devices employing different ink supplying methods. Accordingly, it is unnecessary to develop and manufacture valve units for each type of ink supplying methods.

(3) The laminate layer film plate 73 is partially removed by etching to expose part of the film 78. Then, the exposed part of the film is subjected to a flexing process. Accordingly, the pressure receiving plate 79*a* and film 78*a* are relatively simple to manufacture. If the laminate layer film plate were to be manufactured by adhering the plate to film that has already been flexed, is would be difficult to position the film on the plate.

(4) After the laminate body 51 has been completed, the seal member 85 and valve body 86 are assembled on the laminate body 51. When parts such as the seal member 85 and valve body 86 are assembled while manufacturing the laminate body 51, a process for adhering the thin plate of the uppermost layer would become necessary. This may stain parts with the adhesive. Moreover, there is a possibility that the thin plate of the uppermost layer may separate when the thin plate of the uppermost layer receives a reaction force from the plate spring portion. However, in the first embodiment, the parts (85 and 86) are assembled after the laminate body 51 has been completed. Thus, the valve unit 50 can be manufactured efficiently.

(5) The position of the plate spring 76*b* abutting against the valve body 86 is displaced by a predetermined amount from the axis (axis of the seal member 85) of the valve body 86. The axis of the shaft portion 89 is also displaced a predetermined amount from the axis of the valve body 86 (axis the seal member 85) in a direction opposite that of the plate spring 76*b*. Thus, the position of the plate spring 76*b* abutting against the valve body 86 is inclined about the valve body 86. The operation of opening and closing the valve body 86 is therefore smoothly performed. Since the shaft portion 89 abuts against the vicinity of the basal end of the pressure receiving plate 79*a*, a force from the pressure receiving plate 79*a* is efficiently transmitted to the valve body 86. This ensures the force necessary to resist the urging force of the plate spring 76*b* when moving the valve body 86.

(6) The shaft portion 89, which functions as a transmission portion for transmitting force from the pressure receiving plate 79*a* to the valve plate portion 87, is integrally formed with the valve body 86. Thus, the valve unit 50 has less parts.

(7) After inserting the valve body 86 into the through hole 76*a* of the laminate body 51, the assembly is completed by rotating the valve body 86 by one half of a rotation. Thus, the valve body 86 is simply assembled in the laminate body 51. Moreover, a groove 88*a* is formed on the head portion 88 of the valve body 86. Thus, valve body 86 may easily be assembled with a tool.

(8) The pressure receiving plate 79*a* (plate 79) is formed of a metal material. Therefore, a high elastic or resilient force for the pressure receiving plate 79*a* is ensured so that the pressure receiving plate 79 readily moves to and returns from the elastic or resilient displacement position. As a result, response for the valve opening and closing operations in accordance with changes in the ink pressure of the fluid pressure chamber 80 is improved, and the pressure regulation accuracy of the valve unit 50 is improved. Further, the plate spring 76*b* is formed of metal material. Therefore, a high elastic force is also ensured in the plate spring 76*b*. That is, sufficient urging force for urging the valve body 86 in the closing direction is ensured, and the valve body 86 closes rapidly. This improves the response of the valve body 86 and enables highly accurate pressure adjustment.

(9) The flow passage (through hole 74*a*) communicating the fluid pressure chamber 80 and the input port 52 of the valve unit 50 and the flow passage (hole 74*b*) communicating the fluid pressure chamber 80 and the output port 72 are formed in the flow passage plate 74 of the upper layer in the fluid pressure chamber 80. Accordingly, the film 78*a* supported by the pressure receiving plate 79*a* is firmly supported by the plates 77 and 79. As a result, laminar assembly may be accomplished in a state in which the output port 72 is aligned with the input port of a subject component (head chip 32) of the valve unit 50.

(10) The laminate body 51 of the valve unit 50 may be manufactured by laminating large thin plates to manufacture a mother laminate body and then cutting the mother laminate body. This enables a plurality of laminate bodies 51 to be simultaneously manufactured. Thus, the valve unit 50 may be mass produced.

(11) The ultra compact valve unit 50 is built into the recording head 16. The valve unit 50 may therefore be arranged in a flow passage downstream from the filter 34. This prevents relatively large bubble trapped in the filter 34 from increasing the dynamic pressure and prevents the negative pressure of the fluid pressure chamber 80 from becoming unstable. The fluid pressure of the ink chamber 68 is therefore stably maintained. As a result, ink droplets are discharged at a stable discharge amount, and high quality printing is ensured.

(12) The valve unit 50 is built into the recording head 16. Thus, a differential pressure valve may be omitted from the cartridge 20. This enables reduction in the size of the cartridge without changing the amount of ink filling the cartridge. Further, the amount of ink filling the cartridge may be increased when using a cartridge having the same size. Furthermore, the manufacturing cost may be reduced for the consumable cartridges 19 and 20 since valve units such as differential valves are not needed in cartridges 19 and 20.

(13) The ink pressure is regulated in the flow passage downstream from the valve body 86 by opening and closing the valve body 86 with the pressure difference between the fluid pressure chamber 80 and the atmospheric pressure chamber 81. The ink pressure is accordingly adjusted based on the generally stable atmospheric pressure. Thus, the ink pressure is stably regulated.

(14) The valve body 86 is urged in a direction that closes the valve by the plate spring 76*b* of the valve anchor plate 76. Thus, large components such as a coil spring are therefore not necessary to apply urging force to the valve body 86. As a result, the valve unit 50 may be thin.

(15) The plate material for forming the laminate body 51 may be selected from silicon thin plate, glass thin plate, metal thin plate, and laminated thin plate including a metal layer. The film 78*a* of the laminate body 51 is therefore covered by a metal material or an inorganic material having low gas permeability. Thus, the valve unit 50 resists gas permeation.

A valve unit 90 according to a second embodiment of the present invention will now be discussed with reference to FIGS. 11 through 14.

Figure 14:
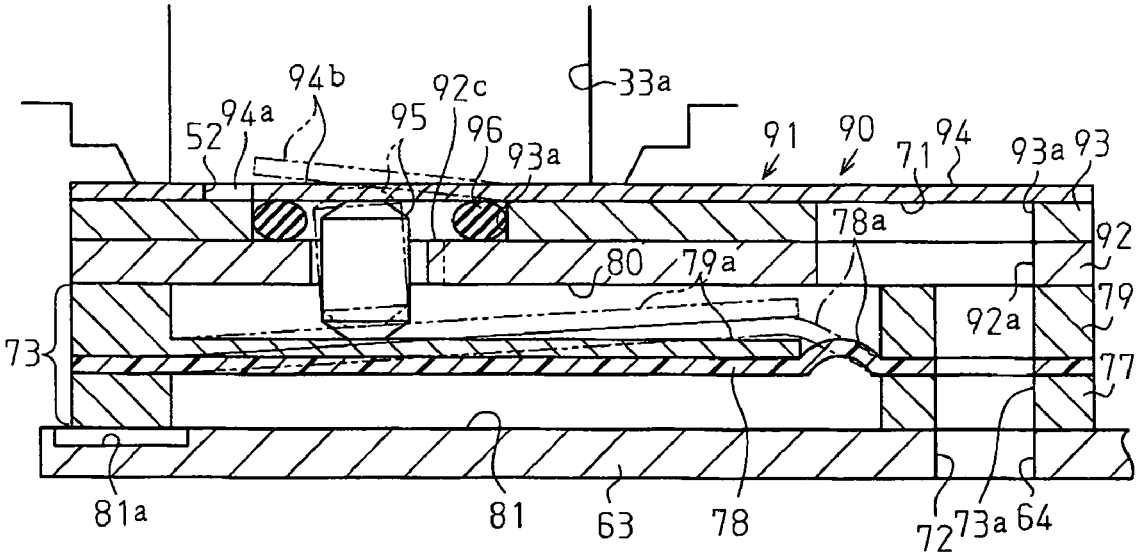
FIG. 14 is a schematic cross-sectional view of the valve unit of FIG. 11.

As shown in FIG. 14, the valve unit 90 of the second embodiment includes a laminate body 91 serving as a main body, a rod 95, a valve portion 94*b*, and a seal member 96 (O-ring). The rod 95 functions as the transmission portion of the present invention. The rod 95 is displaced vertically by a pressure receiving plate 79*a*, which is displaced based on the pressure difference between the fluid pressure chamber 80 and the atmospheric pressure chamber 81. The valve portion 94*b* opens and closes based on the vertical movement of the rod 95. The laminate body 91 is formed in the same way as the first embodiment, and has a thickness of approximately 1 mm.

Figure 11:
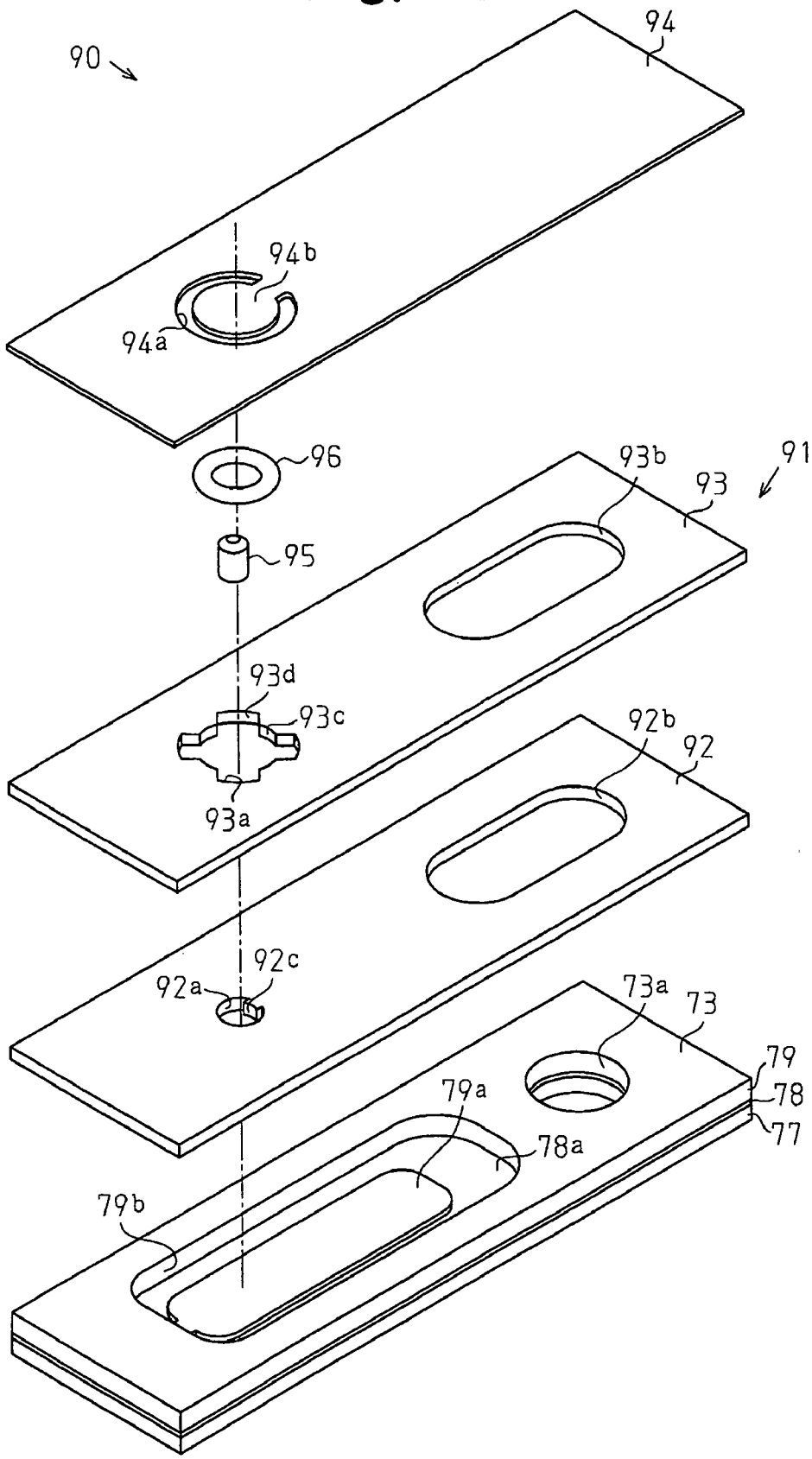
FIG. 11 is a schematic exploded perspective view showing a valve unit according to a second embodiment of the present invention.

As shown in FIG. 11, the laminate body 91 includes a laminate layer film plate 73, a flow passage plate 92, a rod holding plate 93, and a valve formation plate 94 that function as a plurality of plate members. The laminate layer film plate 73 is formed in the same way as the first embodiment, and has a pressure receiving plate 79*a* and a film 78*a*. The laminate layer film plate 73 also has a through hole 73*a* formed as part of the flow passage 71.

The flow passage plate 92 functions as the second plate member in the present invention. A through hole 92*a* and an elongated hole 92*b*, each functioning as part of the flow passage 71, are formed in the flow passage plate 92. The rod 95 is inserted through the through hole 92*a*. The elongated hole 92*b* is in communication with the through hole 73*a* and the cavity 79*b* of the laminate layer film plate 73. Furthermore, a projection 92*c*, which projects inward from the circumferential surface defining the through hole 92*a*, is formed in the flow passage 92. The projection 92*c* functions as a positioning portion of the present invention, and supports and maintains the eccentricity of the rod 95.

The rod holding plate 93 has an generally cross-shaped through hole 93*a* and an elongated hole 93*b*. The through hole 93*a* has four recesses 93*d* formed at intervals of ninety degrees in the circumferential direction, and four inner wall surfaces 93*c* connecting the four recesses 93*d* and having a diameter smaller than that of the recesses 93*d*. The elongated hole 93*b* is formed at a position facing the elongated hole 92*b* of the flow passage plate 92 and is in communication with the through hole 73*a*, the elongated hole 92*b*, and the cavity 79*b* of the laminate layer film plate 73.

The valve formation plate 94 functions as the third plate member in the present invention. A generally C-shaped arcuate hole 94*a* is formed in the valve formation plate 94. A tongue shaped valve portion 94*b* is formed on the valve formation plate 94 by the arcuate hole 94*a*. The valve portion 94*b*, the through hole 93*a*, and the through hole 92*a* correspond to a position in the vicinity of the basal end of the pressure receiving plate 79*a*. The rod 95 is assembled in the laminate body 91 so as to abut against the upper surface of the basal end of the pressure receiving plate 79*a* through the through holes 92*a* and 93*a*. The seal member 96 is pressed against the inner wall surface 93*c* of the through hole 93*a* so as to circumscribe the through hole 92*a* at the upper surface of the flow passage plate 92. The valve portion 94*b* also functions as a plate spring that applies an urging force to the rod 95 acting from the rod 95 to the pressure receiving plate 79*a*.

Figure 12A:
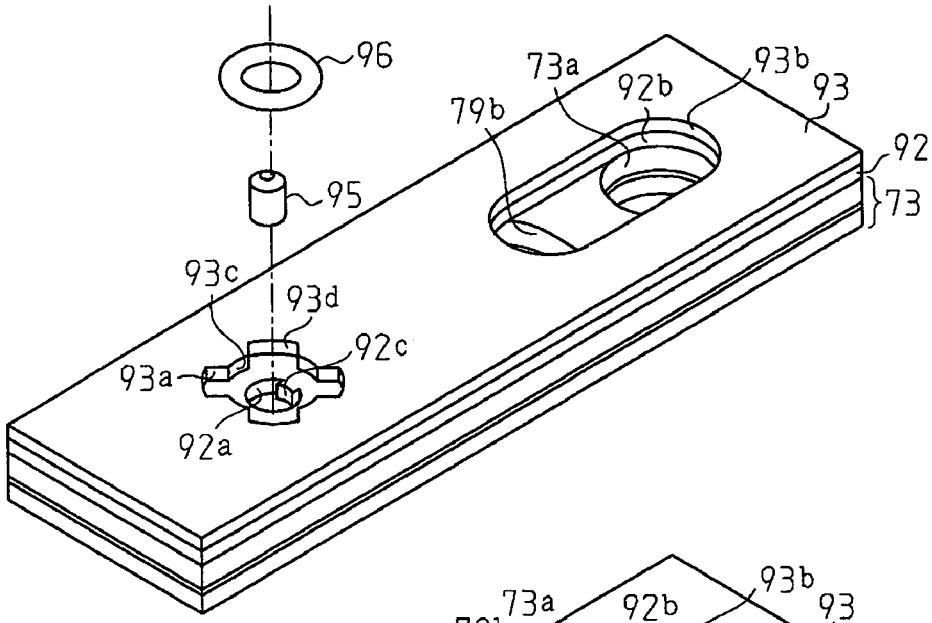
FIG. 12A is a perspective view showing the method of manufacturing the valve unit of FIG. 11.

The method of manufacturing the valve unit 90 is described below. First, referring to FIG. 12A, the three plates of the laminate layer film plate 73, the flow passage plate 92, and the rod holding plate 93 are bonded using an adhesive. In this state, the through hole 73*a* and cavity 79*b* of the laminate layer film plate 73 are in communicate with each other through the elongated holes 92*b* and 93*b*. Then, the rod 95 and seal member 96 are sequentially inserted in the through hole 93*a* of the laminate body, as shown in FIG. 12A.

Figure 13A:
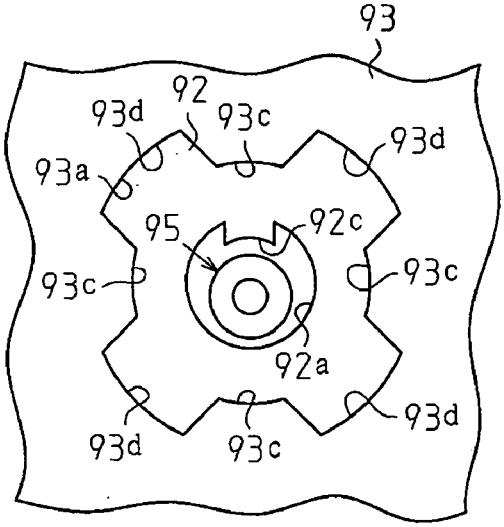
FIG. 13A is an enlarged plan view showing the valve unit of FIG. 11.
Figure 13B:
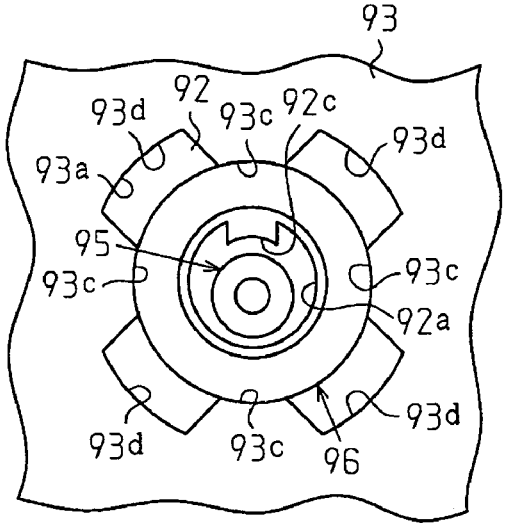
FIG. 13B is an enlarged plan view showing the valve unit of FIG. 11.

As shown in FIG. 13A, the rod 95 is arranged at a position nearer the distal end of the valve portion 94*b* than the center (center of the seal member 96) of the through hole 92*a* or the projection 92*c*. The seal member 96 is positioned by press-fitted to the inner wall surface 93*c* at four locations in the through hole 93*a*. The seal member 96 slightly projects from the opening of the through hole 93*a* of the laminate body.

Figure 12B:
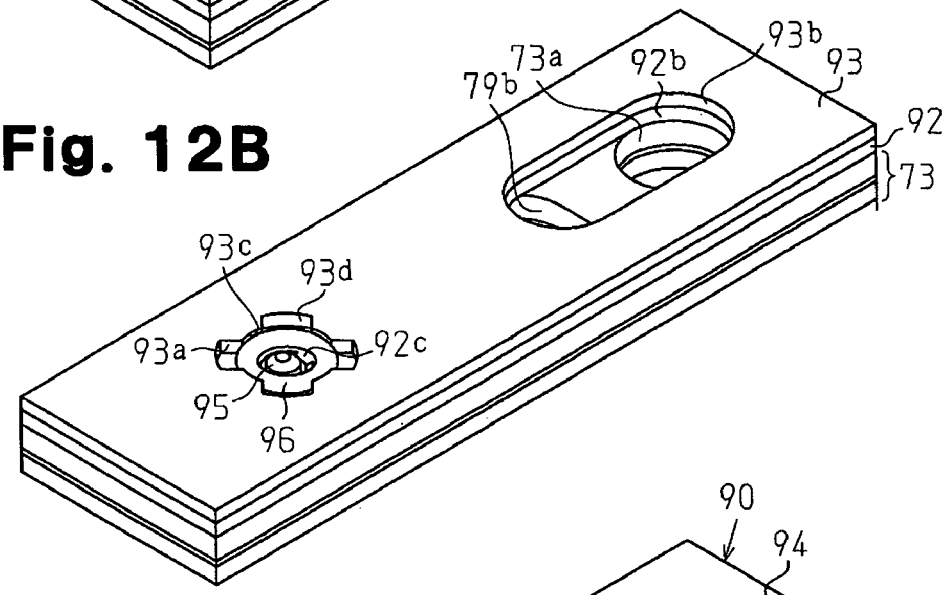
FIG. 12B is a perspective view showing the method of manufacturing the valve unit of FIG. 11.
Figure 12C:
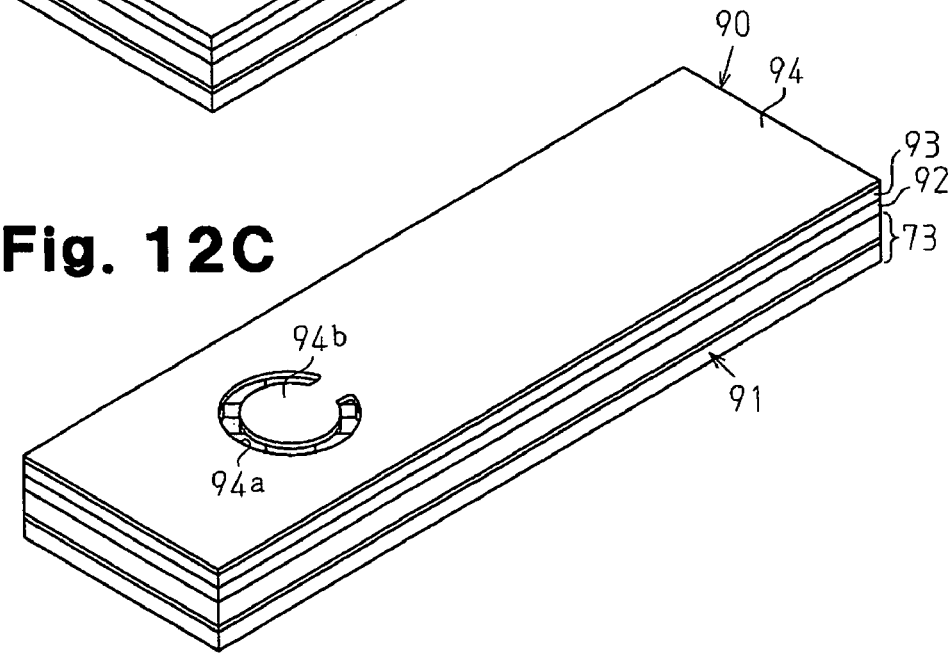
FIG. 12C is a perspective view showing the method of manufacturing the valve unit of FIG. 11.

The valve unit 90 is completed by adhering the valve formation plate 94 to the upper surface of the laminate body shown in FIG. 12B using an adhesive as shown in FIG. 12C. The valve portion 94*b* abuts against the seal member 96 and is slightly lifted. In this state, the valve portion 94*b* is pressed against the seal member 96 by a predetermined urging force produced by the resilient force of the valve portion 94*b*. Thus, the valve portion 94*b* is pressed against the seal member 96, and the valve unit 90 is maintained in a closed state.

As shown in FIG. 14, when there is no pressure difference between the fluid pressure chamber 80 and the atmospheric pressure chamber 81, the pressure receiving plate 79*a* is held at the position indicated by the solid line in FIG. 14. Therefore, the valve portion 94*b* comes into contact with the seal member 96 and closes the valve. When ink droplets are discharged and the amount of ink in the ink chamber 68 and reservoir 65 decreases, the fluid pressure of the fluid pressure chamber 80 is reduced accordingly. As a result, a pressure difference is produced between the fluid pressure chamber 80 and the atmospheric pressure chamber 81, and a force that is in accordance with the pressure difference acts on the pressure receiving plate 79*a*. When the force transmitted from the pressure receiving plate 79*a* to the rod 95 becomes greater than the downward pressing force acting in the direction that closes the valve portion 94*b* (weight of the rod 95 and the urging force of the valve portion 94*b*), the pressure receiving plate 79*a* is inclined so about the basal portion and displaced upward. The inclination lifts the rod 95, which is abut against a position located closer to the basal end of the pressure receiving plate-79*a*. As a result, the valve portion 94*b* is raised, as indicated by the double dashed line in FIG. 14. This opens the flow passage.

When the valve is open, ink in the upstream flow passage 33*a* flows from the gap between the valve portion 94*b* and seal member 96 into the valve unit 90. The ink pressure in the reservoir 65 and ink chamber 68 rises as the ink flows in. This decreases the pressure difference between the fluid pressure chamber 80 and the atmospheric pressure chamber 81. Then, when the force transmitted from the pressure receiving plate 79*a* to the rod 95 becomes less than the downward pressing force acting on the rod 95 (weight of the rod 95 and the urging force of the valve portion 94*b*), the pressure receiving plate 79*a* returns to the origin position and the rod 95 is lowered. This closes the valve (valve portion 94*b*). Thereafter, the valve unit 90 repeats valve opening and closing. As a result, the ink pressure of the reservoir 65 and ink chamber 68 is stably maintained at a predetermined negative pressure, and an appropriate amount of ink droplets are discharged.

In the second embodiment, the rod 95 may abut against a position closer to the distal end of the pressure receiving plate 79*a*. This increases the movement stroke of the rod 95. As a result, the valve unit 90 may further be reduced in size. That is, the desired stroke of the rod 95 may be obtained even when the length of the pressure receiving plate 79*a* is relatively short by having the rod 95 abut against a position closer to the distal end of the pressure receiving plate 79*a*.

A recording device including the valve unit 90 of the second embodiment has the advantages described below in addition to advantages (1) through (3), and (8) through (15) of the first embodiment.

(16) The valve portion 94*b* is formed on the valve formation plate 94 of the uppermost layer of the laminate body 91. Therefore, the valve body 86 of the first embodiment is unnecessary. That is, the rod 95 is used in lieu of the valve body 86 in the second embodiment. The rod 95, which functions as a transmitting portion that transmits the displacement of the pressure receiving plate 79*a* to the valve portion 94*b*, eliminates the need for the cutaway recess 87*a* and head portion 88 (groove 88*a*) of the valve body 86. Accordingly, this valve structure is simpler than that of the first embodiment. Thus, the manufacture and structure of the valve unit 90 is simplified.

(17) The rod 95 is arranged in the through hole 92*a* closer to the distal end of the valve portion 94*b* than the center (center of the seal member 96) of the through hole 92*a*. Therefore, the force acting on the pressure receiving plate 79*a* is efficiently transmitted to the valve portion 94*b* through the rod 95. As a result, the opening and closing of the valve is efficiently performed with a small force. The rod 95 is positioned by the projection 92*c* that projects from the circumferential surface defining the through hole 92*a*. Thus, the diameter of the through hole 92*a* may be sufficiently larger than the diameter of the rod 95. Accordingly, the diameter of the ink flow passage may be increased.

It should be apparent to those skilled in the art that the present invention may be embodied in many other specific forms without departing from the spirit or scope of the invention. Particularly, it should be understood that the present invention may be embodied in the following forms.

(First Modification) The valve unit is not limited to a pressure reducing valve built into a recording head and may be a pressure differential valve built into a cartridge. For example, the atmospheric pressure chamber 81 may be formed as a pressure chamber that is in communication with the flow passage 33*a* and is under pressure equal to the fluid pressure upstream from the valve portion (valve plate portion 87 or valve portion 94*b*). In this case, the valve portion is opened and closed by the pressure differential between the fluid pressure of the pressure chamber upstream from the valve portion and the fluid pressure of the fluid pressure chamber 80 downstream from the valve portion. Therefore, the valve units 50 and 90 operate as pressure differential valves. Furthermore, the valve unit does not have to be arranged in the recording head or cartridge. The valve unit may also be arranged in the flow passage between the recording head and the cartridge. The valve unit may also be arranged in the flow passage between the ink cartridge and the carriage. Moreover, the valve unit may also be arranged inside a sub tank type carriage. In addition, the valve unit may also be arranged inside an off-carriage type cartridge holder.

(Second Modification) The valve unit need not be provided with a pressure receiving plate 79*a*. If the film 78*a* is formed of a quality of material that has a certain degree of strength, the shaft portion 89 or rod 95 may directly abut against the film 78*a*.

(Third Modification) In the first embodiment, the transmission portion may be a projection that projects from the pressure receiving plate 79*a* instead of the shaft portion 89 of the valve body 86. In the second embodiment instead of the rod 95, the transmission portion may be a projection that projects from the pressure receiving plate 79*a* or a projection that projects from the valve portion.

(Fourth Modification) the film 78*a* may also be a rubber film that expands and contracts based on a pressure difference. When the film 78*a* is a rubber film, the process of flexing the film is unnecessary. When the film 78*a* is a resin film, the film 78*a* may be relatively thin since resin generally has high strength and durability.

(Fifth Modification) In the first embodiment, the quality of material of the valve anchor plate 76 (urging and supporting thin plate) is not limited to SUS (single metal layer). The valve anchor plate may be a laminate layer plate that includes at least one metal layer (SUS or the like). In the second embodiment, the quality of the material of the valve formation plate 94 (valve forming thin plate) may be a laminate layer plate that includes at least one metal layer (SUS, copper or the like). Furthermore, the laminate layer film plate 73 (drive supporting thin layer) may be a laminate layer plate formed of only metal layers so as to displace the pressure receiving plate.

(Sixth Modification) The pressure receiving plate 79*a* may be supported by both basal and distal ends or by three or more supports. In this case, it is desirable that the supports have an easily flexed shape so as to aid in the displacement of the pressure receiving plate.

(Seventh Modification) The drive portion for driving the valve portion (87, 94*b*) is not limited to a differential pressure drive portion (film 78*a*) that drives the valve portion based on the pressure difference between the fluid pressure chamber 80 and the atmospheric pressure chamber 81. The drive portion may be a piezoelectric element that is electrically driven. In this case, a piezoelectric element installed in the laminate layer film plate 73 partially displaces the pressure receiving plate 79*a* with an electrostriction action that occurs when a drive voltage is applied. Moreover, the drive portion may be an electrostatic element that partially displaces the pressure receiving plate 79*a* with an electrostatic attraction force based on an electrical charge applied between two electrodes. A drive portion that is electrically driven in this manner drives the valve portion in accordance with the amount of fluid ejected in synchronism with the liquid ejection from the recording device 10 (liquid ejection device). As a result, the valve portion opens and closes for an amount or time that is in accordance with the ejection amount and timing of the liquid ejection.

(Eighth Modification) The valve unit may also include a plurality of valve mechanisms. That is, the valve unit may also be manufactured so as to include a plurality of valve mechanisms when cutting the mother laminate body.

(Ninth Modification) The liquid ejection device may also eject liquid other than ink (liquid including liquid state material containing dispersed particles of a functional material. For example, the liquid ejection device may be for ejecting liquid state material containing dispersed or dissolved material such as a coloring material or an electrode material used to manufacture surface emitting displays, EL (electroluminescence) displays, and liquid crystal displays. The liquid ejection device may also be for ejecting biological organic material used in biochip manufacturing or for ejecting liquids such as samples used in precision pipettes. The valve unit is applicable to any of these types of liquid ejection devices. Moreover, the valve unit is not limited to liquid ejection devices, and may be used in other optional devices.

The present examples and embodiments are to be considered as illustrative and not restrictive, and the invention is not to be limited to the details given herein, but may be modified within the scope and equivalence of the appended claims.

What is claimed is:

1. A valve unit for opening and closing a flow passage, the valve unit comprising:

a laminate body including a plurality of plate members laminated together and forming the flow passage;

a valve portion arranged in the laminate body operable to open and close the flow passage;

a drive portion that generates drive force for driving the valve portion, with the valve portion opening the flow passage based on the drive force of the drive portion; and a transmission portion arranged between the valve portion and the drive portion for transmitting the drive force of the drive portion to the valve portion;

wherein the plurality of plate members includes:

a first plate member including the drive portion;

a second plate member including a hole functioning as part of the flow passage, with the valve portion being moved between a closing position for closing the hole and an opening position for opening the hole based on the drive force of the drive portion transmitted by the transmission portion; and a third plate member arranged above the second plate member and including a through hole into which the valve portion is insertable and a plate spring projecting in parallel with the third plate member from a circumferential surface defining the through hole so as to urge the valve portion to the closing position, wherein the valve portion includes a first position for receiving the drive force from the drive portion and a second position being in contact with the plate spring; and the valve portion pivots and inclines about the second position based on the drive force received at the first position.

2. The valve unit according to claim 1, further comprising:

a seal arranged on the second plate member so as to circumscribe the hole, with the valve portion contacting the seal when moved to the closing position.

3. The valve unit according to claim 1, wherein the laminate body has a thickness of approximately two millimeters or less.

4. The valve unit according to claim 1, wherein:

the drive portion includes a resilient film;

the laminate body further includes a first pressure chamber functioning as part of the flow passage and a second pressure chamber arranged adjacent to the first pressure chamber with the film arranged in between, with the second pressure chamber being disconnected from the flow passage by the film; and the film generates the drive force in accordance with pressure difference between the first and second pressure chambers.

5. The valve unit according to claim 4, wherein the film is a resin film formed to be flexed beforehand.

6. The valve unit according to claim 4, wherein the first plate member includes at least three sub plates that are laminated together, the three sub plates including:

a first sub plate including the film;

a second sub plate including a first opening that is in communication with the hole of the second plate member, the second sub plate and the film forming the first pressure chamber in communication with the first opening; and a third sub plate including a second opening that is in communication with the atmosphere, the third sub plate and the film forming the second pressure chamber in communication with the second opening.

7. The valve unit according to claim 4, wherein:

the second pressure chamber is an atmospheric pressure chamber that is in communication with the atmosphere; and the film is formed to generate the drive force for driving the valve portion when pressure of the first pressure chamber reaches a predetermined negative pressure that is lower than the atmospheric pressure.

8. The valve unit according to claim 4, wherein the first plate member further includes a resilient pressure receiving plate arranged between the transmission portion and the film, with the pressure receiving plate being deformed with the film in accordance with the pressure difference.

9. The valve unit according to claim 1, wherein:

the valve portion includes a first side facing towards the plate spring, a second side opposite the first side, and a predetermined center;

the plate spring is arranged on the first side of the valve portion at a position separated from the center of the valve portion; and the transmission portion is arranged on the second side of the valve portion at a position separated from the center of the valve portion so that the drive force transmitted by the transmission portion tilts the valve portion.

10. The valve device according to claim 1, wherein:

the valve portion includes a recess facing towards the plate spring when the valve portion is inserted into the through hole and a projection for applying an urging force to the valve portion with the plate spring.

11. The valve device according to claim 1, wherein the third plate member is formed of a metal plate or a laminated plate including at least one metal layer.

12. The valve device according to claim 1, wherein:

the first plate member is formed from a plurality of sub plates laminated together and including a drive plate provided with the drive portion;

each of the plurality of sub plates excluding the drive plate being formed by one of a silicon plate, a glass plate, and a metal plate; and each of the plurality of plate member excluding the first plate member being formed by one of a silicon plate, a glass plate, and a metal plate.

13. A liquid ejection device for use with a removably attached liquid container containing liquid, the liquid container including a first flow passage for guiding the contained liquid out of the liquid container, the liquid ejection device comprising:

a liquid ejection unit including a nozzle for ejecting the liquid and a second flow passage for guiding the liquid supplied from the liquid container to the nozzle; and a valve unit for opening and closing a flow passage including the first and second flow passages to regulate pressure of the liquid, the valve unit including:

a laminate body including a plurality of plate members laminated together and forming the flow passage;

a valve portion arranged in the laminate body operable to open and close the flow passage;

a drive portion that generates drive force for driving the valve portion, with the valve portion opening the flow passage based on the drive force of the drive portion; and a transmission portion arranged between the valve portion and the drive portion for transmitting the drive force of the drive portion to the valve portion;

wherein the plurality of plate members includes:

a first plate member including the drive portion;

a second plate member including a hole functioning as part of the flow passage, with the valve portion being moved between a closing position for closing the hole and an opening position for opening the hole based on the drive force of the drive portion transmitted by the transmission portion; and a third plate member arranged above the second plate member and including a through hole into which the valve is insertable and a plate spring projecting in parallel with the third plate member from a circumferential surface defining the through hole so as to urge the valve portion to the closing position, wherein the valve portion includes a first position for receiving the drive force from the drive portion and a second position being in contact with the plate spring; and the valve portion pivots and inclines about the second position based on the drive force received at the first position.

14. A liquid ejection device for use with a removably attached liquid container containing liquid, the liquid ejection device comprising:

a carriage movable along a predetermined path;

a liquid ejection unit mounted on the carriage and including a nozzle for ejecting liquid supplied from the liquid container; and a valve unit, arranged in the liquid ejection unit, for regulating pressure of the liquid ejected from the nozzle, the valve unit including:

a laminate body including a plurality of plate members laminated together and forming the flow passage;

a valve portion arranged in the laminate body operable to open and close the flow passage;

a drive portion that generates drive force for driving the valve portion, with the valve portion opening the flow passage based on the drive force of the drive portion; and a transmission portion arranged between the valve portion and the drive portion for transmitting the drive force of the drive portion to the valve portion;

wherein the plurality of plate members includes:

a first plate member including the drive portion;

a second plate member including a hole functioning as part of the flow passage, with the valve portion being moved between a closing position for closing the hole and a opening position for opening the hole based on the drive force of the drive portion transmitted by the transmission portion; and a third plate member arranged above the second plate member and including a through hole into which the valve portion is insertable and a plate spring projecting in parallel with the third plate member from a circumferential surface defining the through hole so as to urge the valve portion to the closing position, wherein the valve portion includes a first position for receiving the drive force from the drive portion and a second position being in contact with the plate spring; and the valve portion pivots and inclines about the second position based on the drive force received at the first position.

* * * * *